US008933774B2

(12) United States Patent
Yamamoto

(10) Patent No.: US 8,933,774 B2
(45) Date of Patent: Jan. 13, 2015

(54) REACTOR

(75) Inventor: Shinichiro Yamamoto, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/806,406

(22) PCT Filed: Jun. 22, 2010

(86) PCT No.: PCT/JP2010/060573

§ 371 (c)(1),
(2), (4) Date: Dec. 21, 2012

(87) PCT Pub. No.: WO2011/161772

PCT Pub. Date: Dec. 29, 2011

(65) Prior Publication Data

US 2013/0099887 A1 Apr. 25, 2013

(51) Int. Cl.

| | |
|---|---|
| ***H01F 27/28*** | (2006.01) |
| ***H01F 3/14*** | (2006.01) |
| ***H01F 30/06*** | (2006.01) |

(52) U.S. Cl.

CPC ..... *H01F 30/06* (2013.01); *H01F 27/2804* (2013.01); *H01F 3/14* (2013.01)

USPC ..... 336/220; 336/221; 336/212; 336/178; 29/602.1; 29/606

(58) Field of Classification Search

USPC ..... 336/220–222, 184, 178, 170, 147, 183, 336/212, 205

See application file for complete search history.

(56) References Cited

U.S. PATENT DOCUMENTS 3,638,155 A * 1/1972 Combs ..... 336/69
5,926,946 A * 7/1999 Minato et al. ..... 29/606

(Continued)

FOREIGN PATENT DOCUMENTS

JP 59-036918 A 2/1984
JP 61-015311 A 1/1986

(Continued)

OTHER PUBLICATIONS

International Search Report for PCT/JP2010/060573 dated Oct. 12, 2010, pp. 1-2.

(Continued)

*Primary Examiner* — Mangtin Lian
(74) *Attorney, Agent, or Firm* — Ditthavong & Steiner, P.C.

(57) ABSTRACT

Provided are a reactor which can perform step-up/step-down operations and soft switching with a small size and a smaller leakage inductance, and a method of adjusting a leakage inductance of the reactor. A reactor 1A includes a magnetic core 10A having a pair of inner core portions and forming a closed magnetic path, a main coil 11A having main coil elements 11*a* and 11*b*, and a sub-coil 12A having sub-coil elements 12*a* and 12*b*. The coil elements 11*a* and 12*a* are concentrically layered over one of the inner coil portions, and the coil elements 11*b* and 12*b* are concentrically layered over the other inner coil portion. One end portion of a wire 11*w* of the main coil 11A and one end portion of a wire 12*w* of the sub-coil 12A are joined to each other. A spacing between adjacent turns constituting the sub-coil element 12*a* (12*b*) is wider than that between adjacent turns constituting the main coil element 11*a* (11*b*). Thus, the reactor 1A has a smaller leakage inductance.

16 Claims, 13 Drawing Sheets

(56) References Cited

U.S. PATENT DOCUMENTS

| | | | | |
|---|---|---|---|---|
| 2003/0174039 | A1* | 9/2003 | Bodger et al. | 336/223 |
| 2007/0115088 | A1* | 5/2007 | Sugioka | 336/232 |
| 2009/0219006 | A1* | 9/2009 | Gekinozu | 323/304 |

FOREIGN PATENT DOCUMENTS

| | | | | |
|---|---|---|---|---|
| JP | 07-220950 | A | | 8/1995 |
| JP | 08-124760 | A | | 1/1996 |
| JP | 08-330162 | A | | 12/1996 |
| JP | 09-293630 | A | | 11/1997 |
| JP | 10-308315 | A | | 11/1998 |
| JP | 2001-143945 | A | | 5/2001 |
| JP | 2001-267139 | A | | 9/2001 |
| JP | 2003-033013 | A | | 1/2003 |
| JP | 3096267 | U | | 6/2003 |
| JP | 2004-063601 | A | * | 2/2004 |
| JP | 2004-063601 | A | | 2/2004 |
| JP | 3737461 | B2 | | 2/2004 |
| JP | 2006-294728 | A | | 10/2006 |
| JP | 2006-294997 | A | | 10/2006 |
| JP | 2006-294997 | A | * | 10/2006 |
| JP | 2006-310550 | A | | 11/2006 |
| JP | 2007-043765 | A | | 2/2007 |
| JP | 2007-043852 | A | | 2/2007 |
| JP | 2007-103399 | A | | 4/2007 |
| JP | 2007-116066 | A | | 5/2007 |
| JP | 2007-173700 | A | | 7/2007 |
| JP | 2007-180140 | A | | 7/2007 |
| JP | 2007-201203 | A | | 8/2007 |
| JP | 2008-041877 | A | | 2/2008 |
| JP | 2008-066529 | A | | 3/2008 |
| JP | 2010-080907 | A | | 4/2010 |
| JP | 2010-171357 | A | | 8/2010 |
| JP | 2010-171358 | A | | 8/2010 |
| JP | 2010-219254 | A | | 9/2010 |

OTHER PUBLICATIONS

Office Action for related Japanese Patent Application No. 2009-054502 dated Jul. 10, 2012, pp. 1-6.

Office Action for related Japanese Patent Application No. 2009-054501 dated Jul. 10, 2012, pp. 1-7.

Notification of Reasons for Rejection for prior Japanese Patent Application No. 2009-063581 mailed Jul. 12, 2012, pp. 1-6. (Partial English Translation Included).

Notification of Reasons for Rejection for prior Japanese Patent Application No. 2009-112679 mailed Jun. 21, 2012 pp. 1-5. (Partial English Translation Included).

Office Action for related Japanese Patent Application No. 2009-054503 dated Jul. 20, 2012, pp. 1-6.

Office Action for related Japanese Patent Application No. 2009-054503 dated Jul. 10, 2012, pp. 1-6.

* cited by examiner (I)

(II)

(III)

(I)

(II)

(I)

(II)

REACTOR

TECHNICAL FIELD

The present invention relates to a reactor used as a component of a power conversion device, such as a vehicle-loaded DC-DC converter, and a method of adjusting a leakage inductance of the reactor. More particularly, the present invention relates to a reactor, which can perform soft switching and which has a small size.

BACKGROUND ART

A power conversion device for performing step-up and step-down operations between a motor and a power supply is employed as one of parts of a vehicle, such as a hybrid car or an electric car, which utilizes the motor as a driving source or as a power generation source in regeneration. The power conversion device includes a converter for changing the magnitude of electric power.

As an example of the vehicle-loaded converter, there is a two-way DC-DC converter (Patent Literature (PTL) 1, FIG. 6). One component of the converter is a reactor for smoothing a current that is generated with ON/OFF switching operations of a switching device.

As illustrated in FIG. 14, a reactor 1000 typically includes an annular magnetic core 100 made of a magnetic material, and a coil 110 having a pair of coil elements 110*a* and 110*b*, which are each formed by winding a wire 110*w* and which are arranged around respective parts of the magnetic core 100 (PTL 1, FIG. 1). The magnetic core 100 is constructed in an annular shape by combining a pair of inner core portions (not illustrated), which are inserted respectively into the coil elements 110*a* and 110*b*, and a pair of outer cores 100*e*, which are arranged in sandwiching relation to the inner core portions arranged in parallel. The reactor 1000 is placed in, e.g., a case (not illustrated) and is encapsulated with a potting resin (PTL 1, FIG. 3). When the reactor is used, the case is fixed to a cooling base.

Further, PTL 2 discloses a reactor including a magnetic core, generally called a pot type core, which includes a columnar core disposed inside one cylindrical coil, a cylindrical core disposed to cover an outer periphery of the coil, and a pair of disk-shaped cores disposed respectively at end surfaces of the coil, the magnetic core covering substantially the entire outer periphery of the coil (PTL 2, FIGS. 1 and 2). In the pot type core, the columnar core and the cylindrical core, both concentrically arranged, are coupled to each other, thereby forming a closed magnetic path.

A resonance-type DC-DC converter capable of performing soft switching with a smaller switching loss than that in known converters (PTL 3) has been studied in recent years. Such a converter includes an auxiliary circuit including a reactor and a switching device both for resonance, in addition to a reactor for smoothing. PTL 3 discloses an arrangement including an inductor L1, an inductor L2, and an inductor Lr having an inductance value smaller than those of both the inductors L1 and L2 (PTL 3, FIG. 1). The inductor L1 functions as the reactor for smoothing, and the inductors L2 and Lr realize the soft switching.

CITATION LIST

Patent Literature

PTL 1: Japanese Unexamined Patent Application Publication No. 2007-116066

PTL 2: Japanese Unexamined Patent Application Publication No. 2007-201203

PTL 3: Japanese Unexamined Patent Application Publication No. 2007-043852

SUMMARY OF INVENTION

Technical Problem

However, PTL 1 to 3 do not clearly disclose concrete structures of the reactors (inductors) capable of performing the soft switching. It is conceivable, for example, to form the reactor for smoothing and the reactor for resonance as separate members independent of each other. Such a structure, however, is not advantageously used as a vehicle-loaded part, which is desired to have a small installation area and a small size, because of needing a space for installing both the reactors. In particular, when the inductor Lr is a separate member independent of the reactor for smoothing as described in PTL 3, the reactor including the inductor Lr is increased in size corresponding to the presence of the inductor Lr. Further, when the inductor Lr and the reactor for smoothing are separate members, they need to be individually assembled, whereby the number of components and the number of assembly steps are increased, thus resulting in a reduction of productivity.

Accordingly, one object of the present invention is to provide a reactor, which can perform soft switching and which has a small size. Another object of the present invention is to provide a method of adjusting a leakage inductance of a reactor, which can perform soft switching and which has a small size.

Solution to Problem

The present invention achieves the above object by enabling one magnetic core to be utilized in common to a plurality of coils that are used for different functions, more specifically, by arranging a coil functioning as a reactor for smoothing and a coil functioning as a reactor for resonance to one common magnetic core, and by properly setting a spacing between turns constituting each of both the coils.

The reactor according to the present invention includes a main coil formed by spirally winding a wire, a sub-coil formed by spirally winding a wire that is different from the wire constituting the main coil, and a magnetic core to which both the main coil and the sub-coil are arranged, the magnetic core forming a closed magnetic path. One end portion of the wire constituting the main coil and one end portion of the wire constituting the sub-coil are joined to each other. Further, the sub-coil is arranged such that at least part of turns constituting the sub-coil is overlapped with the main coil. Still further, the sub-coil has a portion in which a spacing between adjacent turns constituting the sub-coil is wider than a spacing between adjacent turns constituting the main coil.

The reactor of the present invention can be formed, for example, with the following method of adjusting a leakage inductance of a reactor, according to the present invention. The method of adjusting the leakage inductance of the reactor, according to the present invention, includes the steps of arranging a main coil, which is formed by spirally winding a wire, around a magnetic core, arranging a sub-coil, which is formed by spirally winding a wire different from the wire constituting the main coil a main coil, such that the sub-coil is overlapped with at least part of the main coil. Further, the sub-coil is arranged to have a portion in which a spacing between adjacent turns constituting the sub-coil is wider than a spacing between adjacent turns constituting the main coil, thereby reducing a leakage inductance.

The reactor of the present invention can operate, for example, such that the main coil and the magnetic core function as a reactor for smoothing, and that the sub-coil and the same magnetic core function as a reactor for resonance. In other words, the reactor of the present invention can perform not only step-up and step-down operations, but also soft switching. In the reactor of the present invention, particularly, since the main coil and the sub-coil share one common magnetic core, an installation area and a size of the reactor are reduced in comparison with those when the smoothing reactor and the resonance reactor are independent separate members. Further, since the main coil and the sub-coil are assembled in a state overlapping with each other in at least parts thereof, a size (e.g., a length in the axial direction of the main coil) of the entire reactor can be reduced in comparison with the case where the main coil and the sub-coil are arranged at different positions of the magnetic core in a separated way. This also contributes to reducing the size of the reactor of the present invention. Moreover, with the reactor of the present invention, since the number of components is smaller than when the smoothing reactor and the resonance reactor are separate members, as described above, the number of assembly steps can be reduced and higher productivity is obtained.

The method of adjusting the leakage inductance of the reactor, according to the present invention, enables the reactor of the present invention, having a small leakage inductance (also simply called a leakage), to be easily formed. The leakage inductance can be reduced, for example, by widening the spacing between the adjacent turns constituting the sub-coil. However, when the spacing between the adjacent turns constituting the main coil is wide, the spacing between the turns of the sub-coil also needs to be widened correspondingly. Therefore, the length of the assembly of the main coil and the sub-coil in the axial direction thereof is increased, thus resulting in a larger size of the reactor. Further, from the viewpoint of increasing a space factor of a coil, the spacing between adjacent turns constituting the coil is desirably as small as possible. Accordingly, when a coil to which a large current is supplied, e.g., the main coil, is utilized as the smoothing coil, the spacing between the adjacent turns of the main coil is preferably as small as possible, and more preferably the turns are positioned substantially in a contact state. The sub-coil is arranged with respect to the main coil, having the narrow spacing between the turns as mentioned above, such that the sub-coil is overlapped with at least part of the main coil, and that the sub-coil has a portion in which the spacing between the adjacent turns constituting the sub-coil is wider than that in the main coil. With that arrangement, the leakage inductance can be effectively reduced, and the length of the assembly of the main coil and the sub-coil can be shortened. As a result, the reactor obtained with the method of the present invention has a small installation area, a small size, and a small leakage inductance, and it can satisfactorily perform the soft switching. Moreover, with the method of the present invention, the reactor having the desired leakage inductance can be easily formed by adjusting the spacing between the turns of the sub-coil.

In one embodiment of the present invention, the sub-coil is concentrically arranged around the main coil (that embodiment is referred to as a layered form hereinafter). In another embodiment of the present invention, in the portion of the sub-coil in which the spacing between the turns of the sub-coil is wider, the main coil and the sub-coil are assembled such that at least one of the turns constituting the main coil is present between the turns of the sub-coil (that embodiment is referred to as an interposed form hereinafter).

The layered form and the interposed form, described above, are practical forms of the reactor of the present invention in which at least part of the turns of the sub-coil is overlapped with the main coil. In the layered form, the sub-coil and the main coil are arranged in a layered state where an inner peripheral surface of at least one turn of the sub-coil is substantially not contacted with an outer peripheral surface of the turn of the main coil. Stated another way, in the layered form, there is a portion in which the main coil and the sub-coil are overlapped with each other in a direction perpendicular to the axial direction of the main coil. In that layered form, as the number of portions where the main coil and the sub-coil are overlapped with each other increases, the length (i.e., the size in the axial direction of the main coil) of the entire reactor is reduced, and the installation area of the reactor is reduced. For example, in a form where all the turns of the sub-coil are arranged around the main coil, the length of the entire reactor can be minimized. In the interposed form, the sub-coil and the main coil are arranged in an overlapped state where at least one of the turns of the sub-coil is sandwiched between the turns of the main coil. Stated another way, in the interposed form, there is a portion in which a part of the sub-coil is arranged in contact with the main coil, and in which the main coil and the sub-coil are overlapped with each other in the axial direction of the main coil. In that interposed form, the width and the height (each of the width and the height represents a size in the direction perpendicular to the axial direction of the main coil) of the entire reactor can be reduced. This contributes to reducing the reactor size. Further, the interposed form can provide a leakage inductance comparable to or smaller than that in the layered form, and can realize a reactor having a smaller leakage inductance. The layout (assembled state) of both the coils can be selected depending on the desired characteristics.

In one embodiment of the present invention, the spacing between the adjacent turns is even for all of the adjacent turns constituting the sub-coil and is wider than the spacing between the adjacent turns of the main coil.

With the above-described embodiment, since the spacing between the turns is widened uniformly over the entire sub-coil, the leakage inductance can be more effectively reduced than the case where the spacing between the turns is widened only in a portion of the sub-coil. The spacing between the turns of the sub-coil can be appropriately adjusted such that the leakage inductance is held within a predetermined range.

In one embodiment of the present invention, a length of one of the main coil and the sub-coil in an axial direction thereof is shorter than a length of the other coil in an axial direction thereof. Particularly, in both of the layered form and the interposed form, the length of the sub-coil in the axial direction is preferably not longer than that of the main coil in the axial direction.

The leakage inductance tends to reduce at a wider spacing between the adjacent turns of the sub-coil. However, if the spacing is too wide, the length of the sub-coil in the axial direction is increased and the length of the magnetic core, to which the main coil and the sub-coil are arranged, is also increased, thus resulting in a larger size of the reactor. From the viewpoint of reducing the reactor size, therefore, in each of the layered form and the interposed form, it is preferable that the length of the sub-coil in the axial direction is shorter than the length of the main coil in the axial direction or the same as the latter at maximum. The spacing between the adjacent turns of the sub-coil can be sufficiently widened without excessively increasing the length of the sub-coil in the axial direction, for example, by reducing the number of turns (windings) of the sub-coil to be smaller than that of the main coil, or by reducing the thickness of the wire constituting the sub-coil to be thinner than that of the wire constituting the main coil.

In one embodiment of the present invention, a center position of the sub-coil in an axial direction thereof and a center position of the main coil in an axial direction thereof are shifted from each other in the axial direction. The reactor of that embodiment can be formed with the method of adjusting the leakage inductance of the reactor, according to the present invention, by relatively shifting the center position of the main coil in the axial direction and the center position of the sub-coil in the axial direction from each other, and by adjusting the leakage inductance based on an amount of the shift.

With the above-described embodiment, the leakage inductance corresponding to the distance (shift amount) between the center positions of both the coils in the axial direction is obtained. Further, as described above, the leakage inductance corresponding to the spacing between the turns of the sub-coil is obtained. Thus, various values of the leakage inductance can be obtained by adjusting not only the spacing between the turns, but also the shift amount between the center positions. Stated another way, the above-described embodiment can increase the degree of freedom in design of the leakage inductance. Further, the leakage inductance having an appropriate value can be utilized, for example, as the inductor Lr for the soft switching. Accordingly, a reactor including the smoothing reactor L1 and the soft switching reactors L2 and Lr can be obtained by utilizing the leakage inductance of the adjusted value. Moreover, in the layered form and the interposed form, even when the center positions of both the coils are shifted from each other, the reactor length can be shortened and the installation area can be reduced. Hence, the reactor of the above-described embodiment has a small installation area and a small size, and it can satisfactorily perform the soft switching by utilizing the leakage inductance of an appropriate value.

The leakage inductance tends to reduce at a smaller shift amount between the center positions of both the coils. For example, on condition that coil specifications (such as the cross-sectional area of the wire, the length in the axial direction, and the number of turns) are held fixed in the main coil and the sub-coil which are concentrically arranged in the layered form, the leakage inductance is minimized when the shift amount is 0, i.e., when the center positions of both the coils in the axial direction are the same. The larger the shift amount, the longer is a total length of the assembly of the main coil and the sub-coil in the axial direction and the larger is the size of the reactor. In the above-described embodiment in which the center positions are shifted from each other, the length of one of the main coil and the sub-coil in the axial direction is preferably shorter than that of the other coil in an axial direction, as described above, for the reason that the reactor size can be reduced even with a larger shift amount.

The embodiment in which the center positions are shifted from each other in the layered form may be obtained by forming the sub-coil around the main coil such that the center positions of both the coils are shifted from each other, but it can be more easily obtained by concentrically arranging both the coils and then moving one of both the coils. When moving the one coil, the center position can be easily shifted by moving the coil having a shorter length in the axial direction. The axial length of one coil can be shortened, for example, by reducing the number of turns, by employing a thinner wire, or by forming the one coil to have a portion in which the spacing between adjacent turns of the coil is narrowed in comparison with that in the other coil. By employing such a shorter coil as the sub-coil, it is easier to concentrically arrange the sub-coil in layered relation to the main coil, or to form the sub-coil around the main coil, and to move the one coil as described above.

In the case of the interposed form, as one embodiment of the present invention, the sub-coil has a portion in which plural turns constituting the sub-coil are sandwiched together between the turns constituting the main coil.

In the interposed form, the number of turns of the sub-coil (hereinafter referred to as sub-turns), which are arranged between the turns of the main coil (hereinafter referred to as main turns), and the number of main turns sandwiched between the sub-turns are matters optionally selectable. Stated another way, the number of main turns present between the sub-turns may be one or plural. Further, when there are plural positions where the main turn is present between the sub-turns, the numbers of main turns present between the sub-turns at the plural positions may be the same or different from each other. When plural turns constituting the sub-coil are sandwiched together between the turns constituting the main coil as in the above-described embodiment, both the coils can be more easily formed.

In the case of the interposed form, as an alternative embodiment of the present invention, an assembly of the main coil and the sub-coil has a portion in which the wire forming each turn of the main coil and the wire forming each turn of the sub-coil are alternately arranged one by one.

With the above-described embodiment, the assembly of the main coil and the sub-coil can be easily formed, and higher productivity of the reactor can be obtained. Further, in the portion in which the wires of both the coils are alternately arranged, part of the sub-turns is substantially avoided from being positioned around the main turns in crossing relation to the main turns, and the turns of the sub-coil are entirely sandwiched between the turns of the main coil. Therefore, the sub-coil and the main coil are harder to displace, and the alternately arranged state can be maintained with ease. Moreover, in the portion in which the wires of both the coils are alternately arranged, the sub-turns are sandwiched between the main turns as described above, whereby the width and the height of the reactor can be reduced. Thus, the reactor of the above-described embodiment has a small size.

In one embodiment of the present invention, the sub-coil is concentrically arranged around the main coil in the layered form, the wire constituting the main coil and the wire constituting the sub-coil are each a coated rectangular wire or a coated round wire, which includes a conductor made of a rectangular wire or a round wire and an insulating coating layer formed on an outer periphery of the conductor, and an insulating member is interposed between the main coil and the sub-coil arranged around the main coil.

In the present invention, a wire having an insulating coating layer formed on an outer periphery of a conductor can be preferably used as each of the wire constituting the main coil and the wire constituting the sub-coil. By employing the wire having the insulating coating layer, both the coils can be electrically sufficiently insulated from each other even when the turns of both the coils are contacted with each other at some positions. The conductor is typically a wire element made of copper or a copper alloy. A constituent material of the insulating coating layer of the coated round wire or the coated rectangular wire is typically enamel, such as polyamide-imide. Because the coated round wire is generally soft and can be manually wound, it is possible to easily form a coil and to provide a coil with a high space factor by employing the coated round wire. In the case of the layered form, therefore, the sub-coil can be easily formed, for example, by winding the coated round wire around the main coil. Because the coated rectangular wire generally has high rigidity, a coil can be formed by winding the coated rectangular wire with a coil winder and, particularly, a coil having a very high space factor can be obtained. Further, a coil formed of the coated rectangular wire is hard to deform from the desired shape. For example, when forming the above-described embodiment in which the center positions of both the coils are shifted from each other, the coils can be easily moved to be shifted from each other.

In the layered form, when the wires constituting the main coil and the sub-coil are each the coated round wire or the coated rectangular wire, electrical insulation between both the coils can be enhanced, for example, by increasing the thickness of the insulating coating layer of each wire. Alternatively, interposing an additional insulating member between both the coils as in the above-described embodiment is preferable in ensuring reliable insulation between both the coils. The insulating member may be, e.g., insulating paper. The insulating paper is generally thin and hardly affects the size of the reactor even when it is interposed between both the coils. In addition, the insulating paper is available at a low cost and is economical. As an alternative, the insulating member may be a sleeve-like bobbin molded with insulating resin. Providing, on the sleeve-like bobbin, portions for positioning of the main coil and the sub-coil is advantageous in facilitating the positioning of both the coils and in preventing both the coils from displacing from their predetermined positions in the above-described embodiment in which the center positions of both the coils are shifted from each other.

In one embodiment of the present invention, at least one of the wire constituting the main coil and the wire constituting the sub-coil is a coated electric wire, which includes a stranded wire conductor formed by stranding a plurality of elementary wires, and an insulating coating layer formed on an outer periphery of the stranded wire conductor. Further, in one embodiment of the present invention, one of the wire constituting the main coil and the wire constituting the sub-coil is the coated electric wire, and the other wire is a coated rectangular wire or a coated round wire, which includes a conductor made of a rectangular wire or a round wire and an insulating coating layer formed on an outer periphery of the conductor.

The coated electric wire can be utilized as each of the wires constituting the main coil and the sub-coil. Because the coated electric wire is generally soft and is manually wound with ease, a coil can be easily formed using the coated electric wire. Accordingly, in the case of the layered form, for example, the sub-coil can be easily formed by winding the coated electric wire. A constituent material of the insulating coating layer of the coated electric wire is, for example, a tetrafluoroethylene-hexafluoropropylene copolymer (FEP) resin, a polytetrafluoroethylene (PTFE) resin, or silicone rubber. Those materials are superior in electrical insulation. Therefore, when the wire constituting at least one of the main coil and the sub-coil is the coated electric wire, insulation between both the coils can be sufficiently ensured in the layered form where both the coils are concentrically arranged, without additionally interposing the above-mentioned insulating member between both the coils. In that case, because the insulating member is not needed, the number of components can be reduced, and the step of arranging the insulating member can be dispensed with. In the embodiment in which the main coil and the sub-coil are each formed of the coated electric wire, it is possible, as described above, to sufficiently ensure the electrical insulation between both the coils and to provide higher productivity of the assembly of both the coils. In the embodiment in which one coil is formed of the coated electric wire and the other coil is formed of the coated rectangular wire or the coated round wire, it is possible to sufficiently ensure the electrical insulation between both the coils and to provide a coil having a high space factor as described above.

In one embodiment of the present invention, the conductor of the wire constituting the sub-coil is made of aluminum or an aluminum alloy.

When the sub-coil is utilized as an element of a resonance reactor, for example, a current supplied to the sub-coil is comparatively small. Therefore, the wire constituting the sub-coil may be a wire including a conductor with a smaller cross-sectional area, or a wire having lower electrical conductivity, e.g., a wire including a conductor made of aluminum or an aluminum alloy as in the above-described embodiment. The aluminum or the aluminum alloy has lower electrical conductivity than copper or a copper alloy, but it is light. Therefore, the above-described embodiment can contribute to reducing the weight of the reactor.

In one embodiment of the present invention, at least one of the main coil and the sub-coil is an edgewise coil that is formed by winding the coated rectangular wire in an edgewise manner.

The edgewise winding can easily provide a coil having a high space factor and a shorter length in the axial direction thereof. Accordingly, for a magnetic core to which the edgewise coil is arranged, it is possible to shorten the length of the magnetic core in the axial direction of the edgewise coil. Thus, the reactor of the present invention, including the edgewise coil, has a small size because the axial length of the edgewise coil is shortened. Further, since the edgewise coil and a later-described flatwise coil have high rigidity, the coil can be easily moved when forming the embodiment in which the center positions of the main coil and the sub-coil are shifted from each other, as described above.

In one embodiment of the present invention, the sub-coil is concentrically arranged around the main coil in the layered form, and the sub-coil is a flatwise coil that is formed by winding a coated rectangular wire in a flatwise manner, the coated rectangular wire including a conductor made of a rectangular wire and an insulating coating layer formed on an outer periphery of the conductor.

In the layered form where the sub-coil is arranged around the main coil, the size (width and height) of the reactor tends to increase in the direction in which both the coils are layered. However, the above-described embodiment can provide a small reactor because the reactor size in the layered direction of both the coils can be reduced in comparison with the case where both the coils are the edgewise coils. In particular, when the number of turns of the sub-coil is small, the reactor size can be reduced because the axial length of the sub-coil is held short even when the sub-coil is formed as the flatwise coil. In the above-described embodiment or an embodiment, described below, using a sheet-like wire, the wire constituting the main coil may be any of the coated electric wire, the coated rectangular wire, and the coated round wire.

In one embodiment of the present invention, the sub-coil is concentrically arranged around the main coil in the layered form, and the wire constituting the sub-coil is a sheet-like wire that is formed by laminating an insulating material on a surface of a foil-like conductor.

With the above-described embodiment, since the thickness of the wire constituting the sub-coil is thin, a small reactor can be obtained, as in the foregoing embodiment where the sub-coil is the flatwise coil, because the reactor size in the layered direction of the main coil and the sub-coil can be reduced. Further, since the sheet-like wire is softer than the coated rectangular wire, it can be easily formed into a coil. From that point, the above-described embodiment ensures higher productivity of the reactor. A constituent material of the foil-like conductor may be, for example, copper, a copper alloy, aluminum, or an aluminum alloy.

In one embodiment of the present invention, at least one of the wire constituting the main coil and the wire constituting the sub-coil is formed by winding a coated rectangular wire including a conductor made of a rectangular wire and an insulating coating layer formed on an outer periphery of the conductor, and one end portion of the wire constituting the main coil and one end portion of the wire constituting the sub-coil are joined to each other by welding.

Usually, a terminal member to be connected to an external device is attached to each of one end portion of the wire constituting the main coil and one end portion of the wire constituting the sub-coil. In a typical form for joining the one end portion of the wire constituting the main coil and the one end portion of the wire constituting the sub-coil to each other, therefore, the terminal members attached to the respective one end portions of the wires of both the coils are connected to each other using a bolt, for example. Alternatively, the respective one end portions (conductors) of the wires of both the coils may be directly joined to each other. In that directly joined form, since one terminal member can be used in common to the respective one end portions of the joined wires, the number of terminal members can be reduced, and the number of components can be reduced. Further, when the directly joined form is employed in addition to the above-described embodiment in which at least one of the wires constituting the main coil and the sub-coil is the coated rectangular wire, the joining strength can be increased because a sufficient joining area can be ensured with the coated rectangular wire. In particular, when the main coil and the sub-coil are both the coated rectangular wires, the joining strength can be further increased. On the other hand, in the embodiment in which the main coil and the sub-coil are joined to each other through the terminal members, desired types of wires can be used as the wires constituting the coils because both the coils can be easily joined to each other even when the types of the wires constituting the coils are different.

In one embodiment of the present invention, at least one of the main coil and the sub-coil includes a pair of coil elements, and the magnetic core is an annular member including a pair of inner core portions over which the coil elements are arranged, respectively, and outer core portions arranged in sandwiching relation to the inner core portions that are arranged in parallel (that embodiment will be referred to as a toroidal form hereinafter). Alternatively, in one embodiment of the present invention, the magnetic core includes an inner core portion arranged inside the main coil, an outer core portion arranged outside an assembly of the main coil and the sub-coil, and a connecting core portion arranged at end surfaces of the main coil and the sub-coil (that embodiment will be referred to as an E-E form hereinafter).

In the above-described toroidal form, even when the number of turns of each of the main coil and the sub-coil is large, for example, the number of turns for each of the coil elements can be reduced and the length of the main coil in the axial direction can be reduced in the assembly of the main coil and the sub-coil even with the spacing between the adjacent turns of the sub-coil being wider. Thus, the toroidal form can provide a small reactor. In the above-described E-E form, since the main coil and the sub-coil are each formed of only one coil element and both the coils are arranged over only one inner core portion, the reactor can be obtained in a smaller size than that in the toroidal form including a pair of inner core portions. Further, in the E-E form, since the coils are arranged with respect to the magnetic core over just one inner core portion, an assembled unit of the magnetic core and the coils can be more easily fabricated, and higher productivity of the reactor can be obtained. Moreover, since the coils are not arranged over the outer core portions and the connecting core portions, heat generated from the coils and the magnetic core can be more readily dissipated from the outer core portions and the connecting core portions. Thus, the E-E form is superior in heat dissipation effect as well. In particular, it is expected that the reactor in the E-E form can be suitably applied to, e.g., the case where the number of turns is small and a gap to be provided in the magnetic core for inductance adjustment is small.

When each of the main coil and the sub-coil includes a pair of coil elements in the toroidal form, the pair of coil elements of each coil may be formed of separate wires or one continuous wire. In the former case, each coil can be obtained as a coil (referred to as a joined coil hereinafter) in which respective one end portions of the wires constituting the pair of coil elements are joined together by, e.g., welding. In the latter case, each coil can be obtained as a coil (referred to as a continuous coil hereinafter) in which the pair of coil elements are coupled together through a folded-back portion that is formed by folding back a part of the wire, or through a bridging portion that is a part of the wire. Both the main coil and the sub-coil may be the joined coils or the continuous coils. Alternatively, one of the main coil and the sub-coil may be the joined coil, and the other coil may be the continuous coil. The above-mentioned welding can be performed as, e.g., TIG welding, laser welding, or resistance welding. Pressure bonding, cold pressure welding, vibration welding, or the like can also be used as a wire joining method other than the above-mentioned welding. The above-mentioned welding enables the respective end portions of the wires to be easily joined to each other and has good workability. The cold pressure welding is advantageous in that, because the wires are substantially not heated in a joining step, a risk of damaging the insulating coating layer on the conductor surface is less.

The above-described toroidal form may be modified as follows. The coil elements of the above-mentioned one coil are each an edgewise coil that is formed by winding a coated rectangular wire in an edgewise manner, the coated rectangular wire including a conductor made of a rectangular wire and an insulating coating layer formed on an outer periphery of the conductor, and the one coil including the coil elements is a joined coil that is formed by welding respective one end portions of the coated rectangular wires constituting the coil elements to each other.

With the above-described modified form, since the coil elements of the one coil are separable, those coil elements can be easily arranged with respect to the other coil, and good workability in assembly is obtained. In particular, when each of the main coil and the sub-coil includes a pair of coil elements and is the joined coil, the reactor can be easily assembled in the layered form or the interposed form. Further, with the above-described modified form, since the coated rectangular wire provides a sufficient contact area for the joining, the coil elements can be easily joined to each other and high joining strength is obtained. While an operation of connecting the pair of coil elements to each other may be performed at desired timing, the operation is preferably performed after fabricating the assembly of the main coil and the sub-coil (including the above-described step of shifting the center positions), from the viewpoint of facilitating the assembly work and the movement of the coils and ensuring more efficient work.

The above-described toroidal form may be modified as follows. The coil elements of the above-mentioned one coil are each an edgewise coil that is formed by winding a coated rectangular wire in an edgewise manner, the coated rectangular wire including a conductor made of a rectangular wire and an insulating coating layer formed on an outer periphery of the conductor, the above-mentioned one coil including the coil elements is formed of one continuous coated rectangular wire, and the coil elements of the above-mentioned one coil are coupled to each other through a folded-back portion that is formed by folding back a part of the coated rectangular wire.

With the above modified form, an operation of connecting both the coil elements by welding, for example, is not needed, and the number of assembly steps is reduced.

The above-described toroidal form may be modified as follows. The sub-coil includes a pair of coil elements, each of the coil elements having a portion in which the spacing between the turns is wider, and at least part of a wire forming turns of one of the coil elements and at least part of a wire forming the turns of the other coil element are arranged in overlapping relation in an axial direction of the sub-coil.

Since each of the coil elements of the sub-coil has a portion in which the spacing between the adjacent turns is wider than that in the main coil, both the coil elements include portions in which clearances are each present between the turns. Therefore, the above-described modified form where the at least parts of the wires of both the coil elements are arranged in overlapping relation in the axial direction of the sub-coil can be obtained by overlapping the turns of one of the coil elements to be each or in plural fitted between the turns of the other coil element in portions of both the coil elements where they are oppositely positioned. With that modified form, the spacing between the oppositely positioned portions of both the coil elements is narrowed corresponding to the overlapped layout of the coil elements in comparison with the case where both the coil elements are independently arranged without being mutually fitted to each other. As a result, the spacing between the inner core portions positioned in parallel can also be narrowed. With that modified form, therefore, the size of the magnetic core (outer core portion) can be reduced, whereby the installation area can be further reduced. That modified form can be applied regardless of whether the wire constituting the sub-coil is the coated electric wire, the coated rectangular wire, or the coated round wire. Moreover, when the sub-coil is provided as the joined coil, it is easier to, after forming each of the coil elements of the sub-coil, to arrange both the coil elements such that the wires of the coil elements are overlapped with each other. Hence higher assembly workability is obtained. Additionally, in the layered form where all the turns of the sub-coil are arranged around the main coil, parts of respective turns of both the coil elements of the sub-coil can be easily overlapped with each other in the axial direction of the sub-coil. When the number of turns of the main coil, which are interposed between the turns of each coil element of the sub-coil, is plural in the interposed form, part of the turns of each coil element of the sub-coil is arranged around the main coil. The parts of the turns of both the coil elements of the sub-coil, which parts are arranged around the main coil, can be arranged in overlapping relation with each other in the axial direction of the sub-coil.

The above-described E-E form may be modified such that the inner core portion includes an air gap. With the presence of a clearance (gap) in the inner core portion over which the coils are arranged, magnetic saturation can be suppressed, and an additional gap member made of a material having lower magnetic permeability than the magnetic core, typically a non-magnetic material, is not needed. It is hence possible to reduce the number of components and to dispense with the step of joining the gap member. The air gap can be formed, for example, as follows. The magnetic core is constructed of a plurality of core pieces that can be combined into an integral core, and sizes and combination of the individual core pieces are adjusted such that a clearance is formed between the core pieces constituting the inner core portion in a combined state. Such a clearance can be utilized as the air gap.

In one embodiment of the present invention, the reactor further includes an outer resin portion covering surroundings of an assembled unit of the magnetic core, the main coil, and the sub-coil.

The assembled unit of the magnetic core, the main coil, and the sub-coil can be utilized, as it is, as the reactor. With the above-described embodiment, however, it is possible to easily handle the assembled unit, as an integral unit, with the provision of the outer resin portion, to protect the magnetic core and both the coils from external environments, such as dusts and corrosion, and to mechanically protect them even in the reactor not including a case.

The thus-constructed reactor of the present invention in any of the above-described forms can be suitably used as a component of a two-way soft-switching converter.

Advantageous Effects of Invention

The reactor of the present invention can perform the soft switching in addition to step-up and step-down operations, and has a small size. The method of adjusting the leakage inductance of the reactor, according to the present invention, can be suitably utilized in forming the reactor of the present invention.

BRIEF DESCRIPTION OF DRAWINGS

FIG. 2(I) illustrates an example of a reactor in a layered form where a main coil and a sub-coil are concentrically layered, and FIG. 2(II) illustrates an example of a reactor in a longitudinally end-to-end arranged form where a main coil and a sub-coil are arranged adjacent to each other in the axial direction.

FIG. 3(I) illustrates an example in which a spacing $t_1$ between turns of the sub-coil is wide, and FIG. 3(II) illustrates an example in which a spacing $t_2$ between the turns of the sub-coil is narrow.

FIG. 5(I) illustrates a coated rectangular wire, FIG. 5(II) illustrates a coated electric wire, and FIG. 5(III) illustrates a coated round wire.

FIG. 7(I) illustrates a reactor of Embodiment 8 in which respective parts of wires of the sub-coils are arranged in an overlapped state, and FIG. 7(II) illustrates the reactor of Embodiment 1.

FIG. 8(I) illustrates an example in which a wire of one sub-coil element and a wire of the other sub-coil element are alternately overlapped with each other one turn by one turn, FIG. 8(II) illustrates an example in which the wire of one sub-coil element and the wire of the other sub-coil element are alternately overlapped with each other two turns by two turns, and FIG. 8(III) illustrates an example in which an end surface of one sub-coil element and an end surface of the other sub-coil element are overlapped with each other.

FIG. 9(I) illustrates an example in which respective center positions of a main coil and a sub-coil are relatively shifted from each other, and FIG. 9(II) illustrates an example in which the respective center positions of the main coil and the sub-coil are aligned with each other.

FIG. 10(I) illustrates an example in which respective turns of a main coil and a sub-coil are alternately arranged one by one, and FIG. 10(II) illustrates an example in which plural turns of the main coil are interposed between turns of the sub-coil.

FIG. 11(I) illustrates an example of a layered form, and FIG. 11(II) illustrates an example of an interposed form.

FIG. 12(I) illustrates an example in which respective center positions of a main coil and a sub-coil are aligned with each other in a layered form, FIG. 12(II) illustrates an example in which the respective center positions of the main coil and the sub-coil are shifted from each other in a layered form, and FIG. 12(III) illustrates an example of a longitudinally end-to-end arranged form.

DESCRIPTION OF EMBODIMENTS

Figure 1:
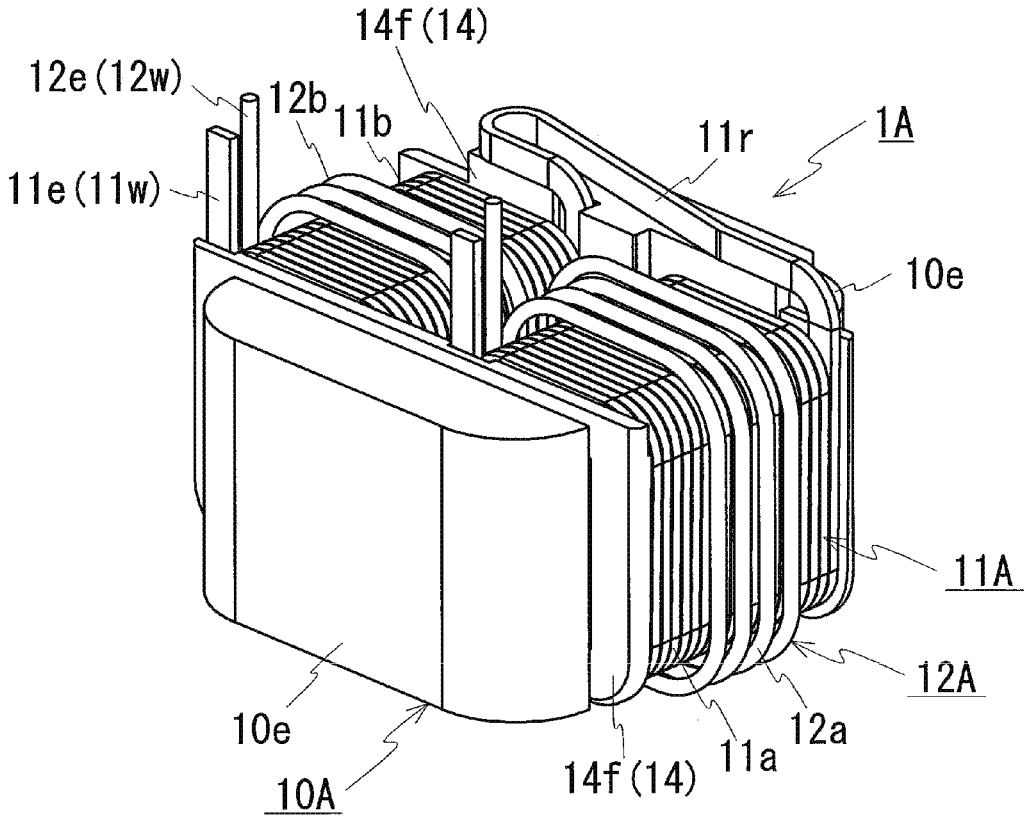
FIG. 1 is a schematic perspective view of a reactor of Embodiment 1.

Embodiments of the present invention will be described below with reference to the drawings. The same symbols in the drawings denote the same components.

Embodiment 1

A reactor 1A of Embodiment 1 is described by primarily referring to FIGS. 1 to 4. In Embodiment 1 described below, the reactor 1A has a toroidal form and a layered form where, in an assembly of a main coil and a sub-coil arranged in the layered form, the main coil arranged on the inner side is constituted using a coated rectangular wire, and the sub-coil arranged on the outer side is constituted using a coated electric wire.

Figure 6:
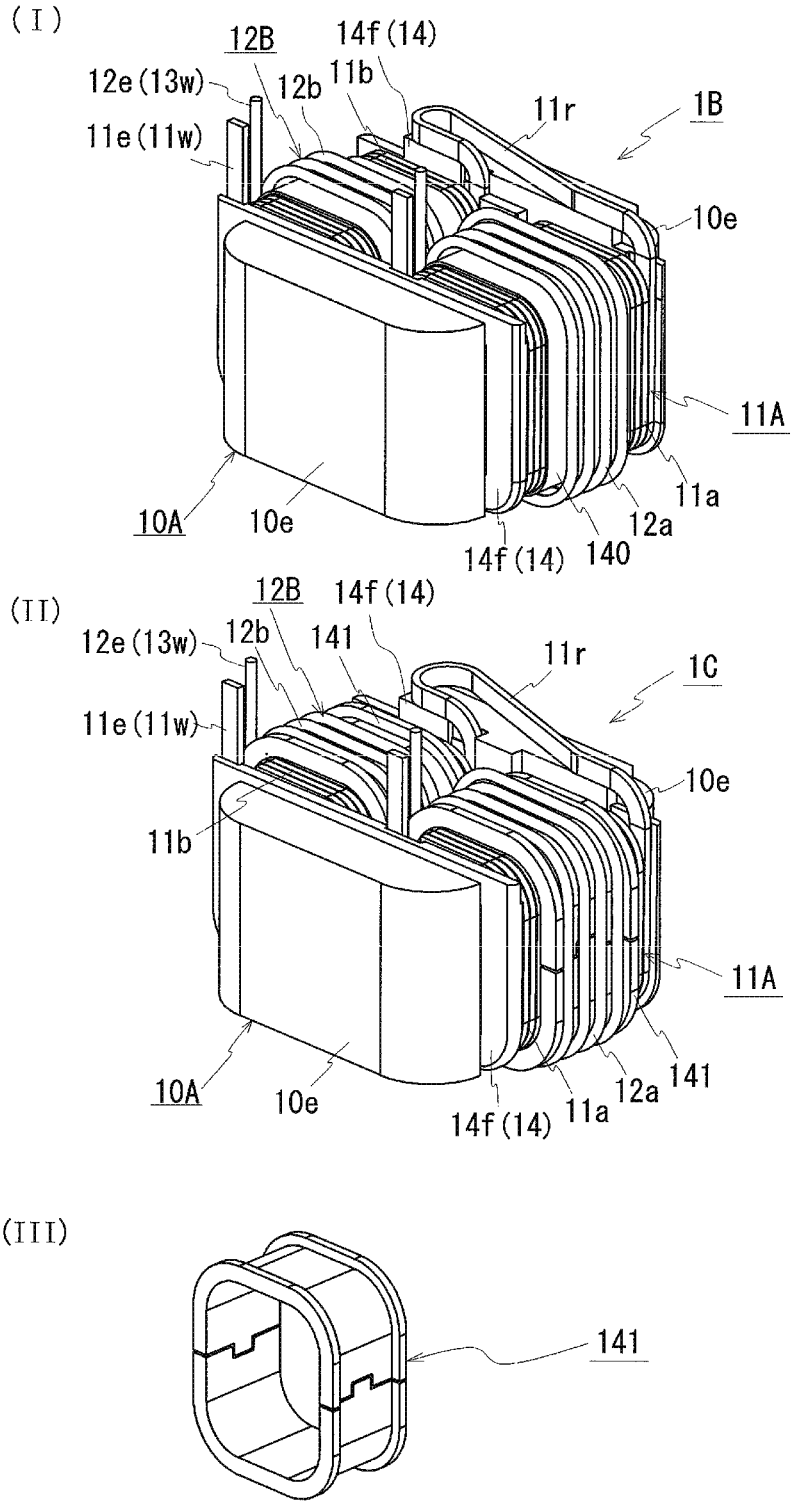
FIG. 6(I) is a schematic perspective view of a reactor of Embodiment 4 in which insulating paper is interposed between the main coil and the sub-coil, FIG. 6(II) is a schematic perspective view of the reactor of Embodiment 4 in which a sleeve-like bobbin is interposed between the main coil and the sub-coil, and FIG. 6(III) is a schematic perspective view of the sleeve-like bobbin.

In FIG. 1 and FIG. 6 described later, a clearance is illustrated as being present between an outer peripheral surface of the main coil and an inner peripheral surface of the sub-coil for easier understanding. In fact, however, both the coils are arranged such that such a clearance is substantially not present. Further, in FIGS. 2 and 3 and FIGS. 7 to 13 described later, end portions, folded-back portions, and bridging portions of wires, and connections of the end portions of the wires are omitted.

The reactor 1A includes an annular magnetic core 10A, a main coil 11A, and a sub-coil 12A, these coils being arranged around part of the magnetic core 10A. The main coil 11A includes a pair of main coil elements 11*a* and 11*b* arranged in parallel. The sub-coil 12A includes a pair of sub-coil elements 12*a* and 12*b* arranged in parallel. The magnetic core 10A and the main coil 11A function, for example, as a smoothing reactor for smoothing a current that is generated with ON/OFF switching operations of a switching device provided in a converter. The magnetic core 10A and the sub-coil 12A function as a resonance reactor that is used for soft switching to reduce a loss of the switching operations. The reactor 1A is featured in that one magnetic core 10A is provided in common to the main coil 11A and the sub-coil 12A, and is further featured in having a portion where a spacing between adjacent turns constituting the sub-coil elements 12*a* and 12*b* is wider than a spacing $t_i$ (not illustrated) between adjacent turns constituting the main coil elements 11*a* and 11*b*. The individual components will be described in more detail below.

[Magnetic Core]

Figure 4:
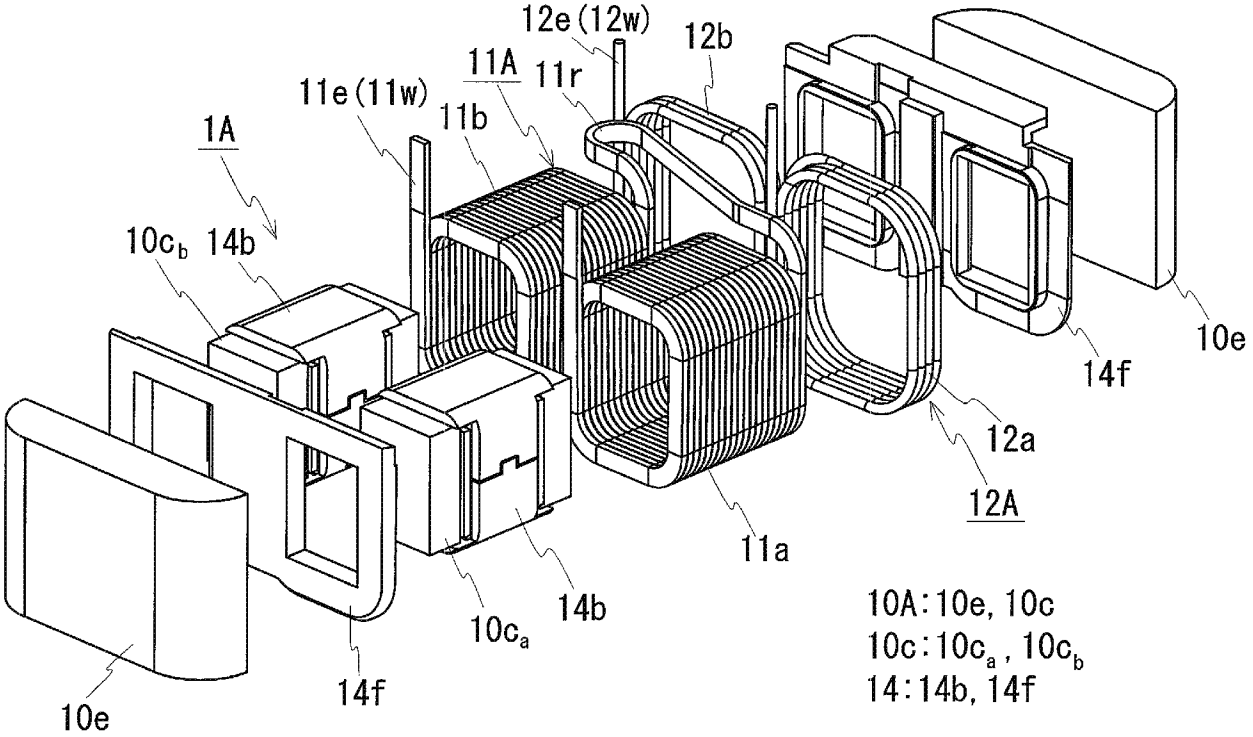
FIG. 4 is an exploded perspective view illustrating a basic structure of the reactor of Embodiment 1.

The magnetic core 10A is described by referring, as required, to FIG. 2(I) and FIG. 4. The magnetic core 10A includes a pair of rectangular-parallelepiped inner core portions $\mathbf{10}c_a$ and $\mathbf{10}c_b$ around which are arranged, respectively, pairs of the main coil elements of the main coil 11A and the sub-coil elements of the sub-coil 12A, i.e., a pair of (the main coil element 11*a* and the sub-coil element 12*a*) and a pair of (the main coil element 11*b* and the sub-coil element 12*b*), and a pair of outer core portions 10*e* around which both the coils 11A and 12A are substantially not arranged. The magnetic core 10A is an annular member forming a closed magnetic path with the outer core portions 10*e* arranged in sandwiching relation to the inner core portions $\mathbf{10}c_a$ and $\mathbf{10}c_b$, which are arranged in parallel in a state spaced from each other. The magnetic core 10A is utilized as a magnetic path when the coils are excited.

The magnetic core 10A is typically constituted by a magnetic substance portion 10*m* that is made of a soft magnetic material containing iron or an iron-based material, e.g., steel, and by a gap member (not illustrated) made of a material having smaller magnetic permeability than the magnetic substance portion 10*m*. More specifically, an inner core portion 10*c* is constituted by alternately layering a core piece, which is made of the magnetic substance portion 10*m*, and a gap member. The outer core portion 10*e* is made of the magnetic substance portion 10*m*.

The core piece can be typically constituted as a powder compact made of soft magnetic powder or a stack formed by stacking a plurality of electrical steel sheets. The gap member is a member arranged in a gap formed between the core pieces for adjustment of inductance (an air gap is also used in some cases). Typically, the gap member is made of a non-magnetic material, e.g., alumina. The core piece and the gap member are integrally joined to each other using, e.g., an adhesive. The number of divisions into individual core pieces and the number of individual gap members can be selected as appropriate such that the main coil 11A and the sub-coil 12A have respective desired inductances. While the magnetic core 10A is constituted here as including the gap member, it may be constituted without including the gap member (or the air gap).

[Main Coil]

The main coil 11A includes a pair of main coil elements 11*a* and 11*b* formed by spirally winding one continuous wire 11*w* (FIG. 1), and a folded-back portion 11*r* interconnecting both the main coil elements 11*a* and 11*b*. The main coil elements 11*a* and 11*b* are arranged side by side such that respective axial directions of both the main coil elements are parallel to each other. As illustrated in FIGS. 1 and 4, the main coil elements 11*a* and 11*b* are interconnected by the folded-back portion 11*r* that is formed by folding back a part of the wire 11*w*.

The wire 11*w* is, as illustrated in FIG. 5(I), a coated rectangular wire having, on the surface of a conductor 11*c* in the form of a copper-made rectangular wire, an insulating coating layer (enamel coating) 11*i* made of polyamide-imide. The main coil elements 11*a* and 11*b* are each an edgewise coil that is formed by winding the coated rectangular wire in an edgewise manner. The main coil elements 11*a* and 11*b* have the same number of turns, have the same length in the axial direction, and are arranged in parallel in a state where respective end surfaces thereof are positioned substantially flush with each other on the same side. Further, the main coil elements 11*a* and 11*b* are each formed such that the spacing $t_i$ between adjacent turns is held as small as possible. Thus, the spacing $t_i$ is substantially zero (i.e., $t_i \approx 0$).

Both end portions 11*e* (FIGS. 1 and 4) of the wire 11*w* constituting the main coil 11A are extended as appropriate, and terminal members (not illustrated) are connected to both the end portions 11*e*. Of the two terminal members connected to the main coil 11A, the terminal member on one end side is connected to a terminal member (not illustrated), which is attached to one end portion 12*e* (FIGS. 1 and 4) of a wire 12*w* (FIGS. 1 and 4) constituting the sub-coil 12A. An external device (not illustrated), such as a power source for supplying electric power to the main coil 11A and the sub-coil 12A, is connected through those terminal members. The end portions 11*e* of the wire 11*w* constituting the main coil 11A and the terminal members can be connected by welding, e.g., TIG welding, laser welding or resistance welding, or by pressure bonding, etc. The above description regarding the end portions of the wires and the terminal members can be similarly applied to other Embodiments and Reference Examples described later.

[Sub-Coil]

As in the main coil 12A, the sub-coil 12A includes a pair of sub-coil elements 12*a* and 12*b* formed by spirally winding one continuous wire 12*w* (FIG. 1). The sub-coil elements 12*a* and 12*b* are also arranged side by side such that respective axial directions of both the sub-coil elements are parallel to each other. The sub-coil elements 12*a* and 12*b* are connected to each other through a bridging portion (not illustrated) that interconnects the sub-coil elements 12*a* and 12*b*.

Figure 5:
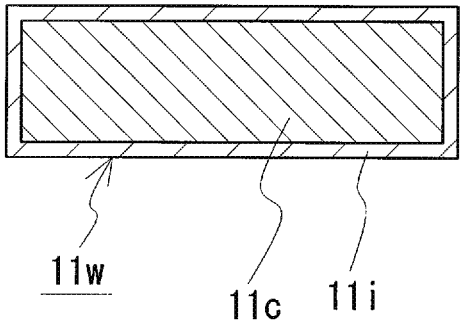
FIG. 5 is a schematic sectional view of a wire used in the reactor; specifically.
Figure 5:
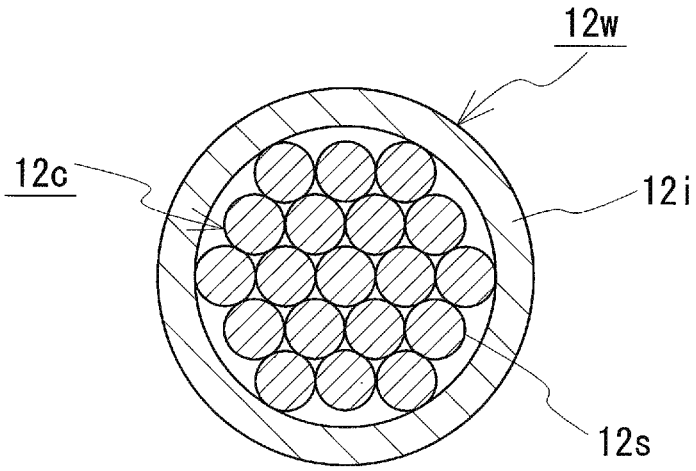
Figure 5:
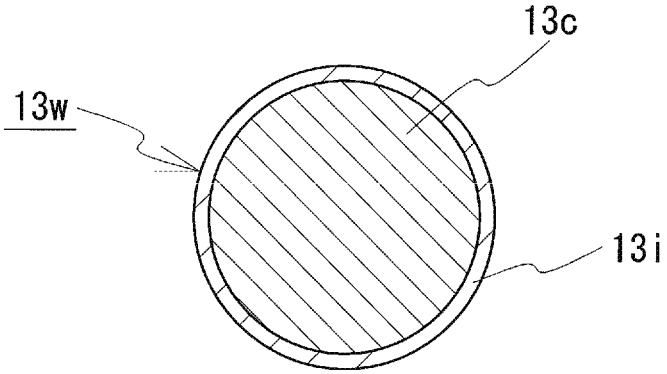

The wire 12*w* is, as illustrated in FIG. 5(II), a coated electric wire having an insulating coating layer 12*i* made of an FEP resin around a stranded wire conductor 12*c* that is formed by stranding a plurality of copper-made elemental wires 12*s*. The sub-coil elements 12*a* and 12*b* have the same number of turns, have the same length in the axial direction, and are arranged in parallel in a state where respective end surfaces thereof are positioned substantially flush with each other on the same side. A conductor cross-sectional area of the wire 12*w* constituting the sub-coil 12A may be smaller than that of the wire 11*w* constituting the main coil 11A, or may be comparable to the latter.

As in the main coil 11A described above, both end portions 12*e* (FIGS. 1 and 4) of the wire 12*w* constituting the sub-coil 12A are extended as appropriate, and terminal members are connected respectively to both the end portions 12*e* in a similar way. Of the two terminal members connected to the sub-coil 12A, the terminal member on one end side is connected, as described above, to the terminal member on the one end side of the wire 11*w* constituting the main coil 11A. In other words, one end portion of the wire 11*w* of the main coil 11A and one end portion of the wire 12*w* of the sub-coil 12A are jointed to each other through the terminal members.

Further, in the reactor 1A, a spacing t between adjacent turns constituting the sub-coil element 12*a* is even for all of the adjacent turns and is wider than the spacing $t_i$ between the adjacent turns constituting the main coil element 11*a* ($t_1 > t_i \approx 0$). Similarly, in the reactor 1A, a spacing t between adjacent turns constituting the sub-coil element 12*b* is even for all of the adjacent turns, is equal to the spacing t in the sub-coil element 12*a*, and is wider than the spacing $t_i$ between the adjacent turns constituting the main coil element 11*b* ($t_1 > t_i \approx 0$). Thus, the spacing t between adjacent twos of all the turns constituting both the sub-coil elements 12*a* and 12*b* is wider than the spacing $t_i$ in the main coil elements 11*a* and 11*b*. Further, in examples illustrated in FIGS. 2(I) and 3(I), the number of turns of the sub-coil element 12*a* (12*b*) is smaller than that of the main coil element 11*a* (11*b*), and an axial length $l_1$ of the sub-coil element 12*a* (12*b*) is equal to the axial length of the main coil element 11*a* (11*b*).

[Layout of Coils with Respect to Magnetic Core]

As illustrated in FIGS. 2(I) and 3(I), one main coil element 11*a* of the main coil 11A and one sub-coil element 12*a* of the sub-coil 12A are arranged around one inner core portion $\mathbf{10}c_a$ of the magnetic core 10A, and the other main coil element 11*b* of the main coil 11A and the other sub-coil element 12*b* of the sub-coil 12A are arranged around the other inner core portion $\mathbf{10}c_b$ of the magnetic core 10A. Particularly, in the reactor 1A, the sub-coil element 12*a* (12*b*) is concentrically layered around an outer periphery of the main coil element 11*a* (11*b*).

Further, in the examples illustrated in FIGS. 2(I) and 3(I), the main coil elements 11*a* and 11*b* and the sub-coil elements 12*a* and 12*b* are arranged around the inner core portions $\mathbf{10}c_a$ and $\mathbf{10}c_b$, respectively, such that a center position of the main coil element 11*a* in the axial direction is aligned with a center position of the sub-coil element 12*a* in the axial direction, and that a center position of the main coil element 11*b* in the axial direction is aligned with a center position of the sub-coil element 12*b* in the axial direction. Moreover, in the examples illustrated in FIGS. 2(I) and 3(I), an end surface of the main coil element 11*a* is substantially flush with an end surface of the sub-coil element 12*a* on one side, and that an end surface of the main coil element 11*b* is substantially flush with an end surface of the sub-coil element 12*b* on the other side. Accordingly, in those examples, all the turns constituting the sub-coil element 12*a* (12*b*) are arranged over the outer periphery of the main coil element 11*a* (11*b*) in overlapped relation.

Figure 2:
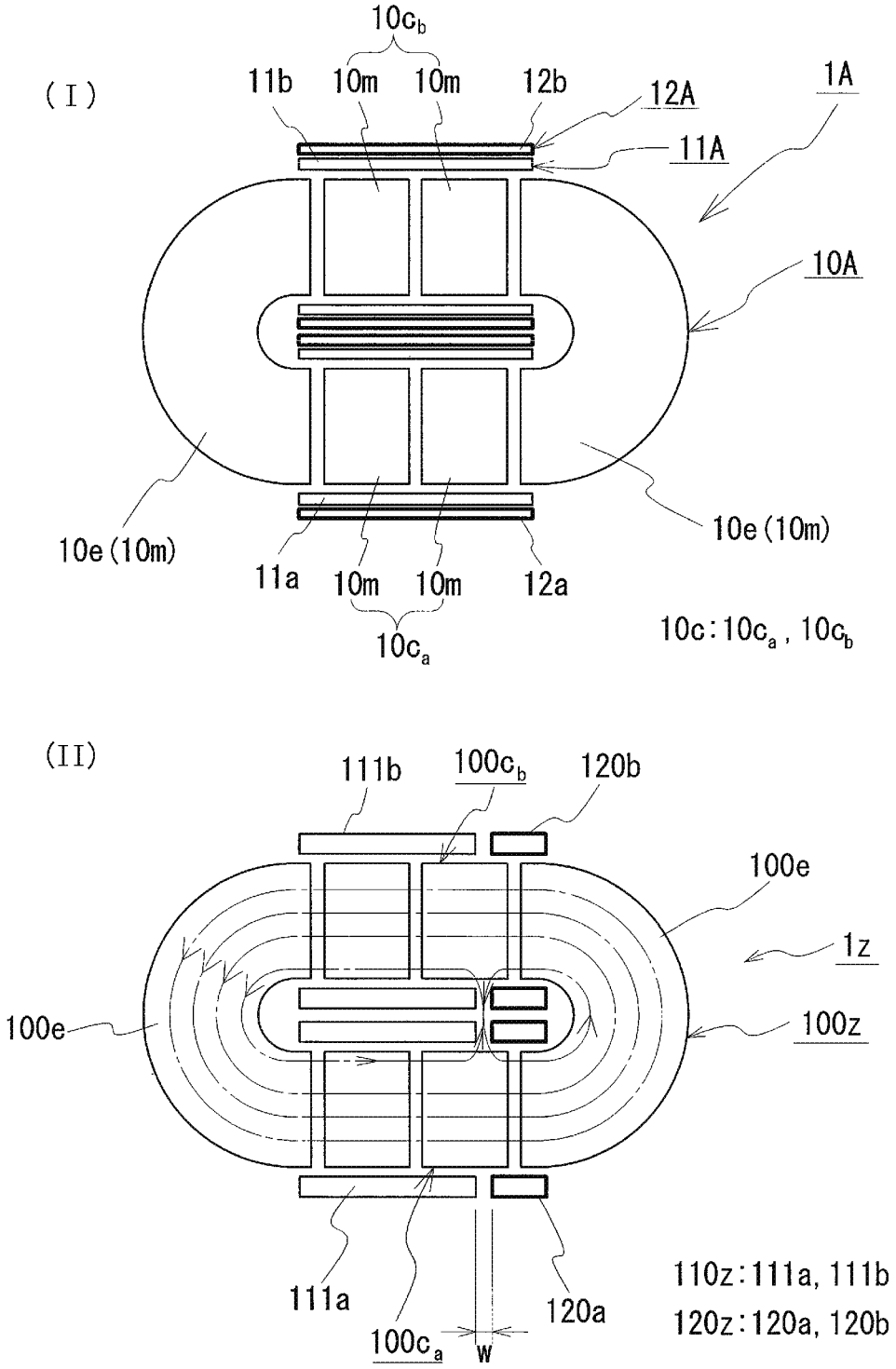
FIG. 2 is a schematic explanatory view to explain the layout of an annular magnetic core and coils, which constitute the reactor; specifically.
Figure 3:
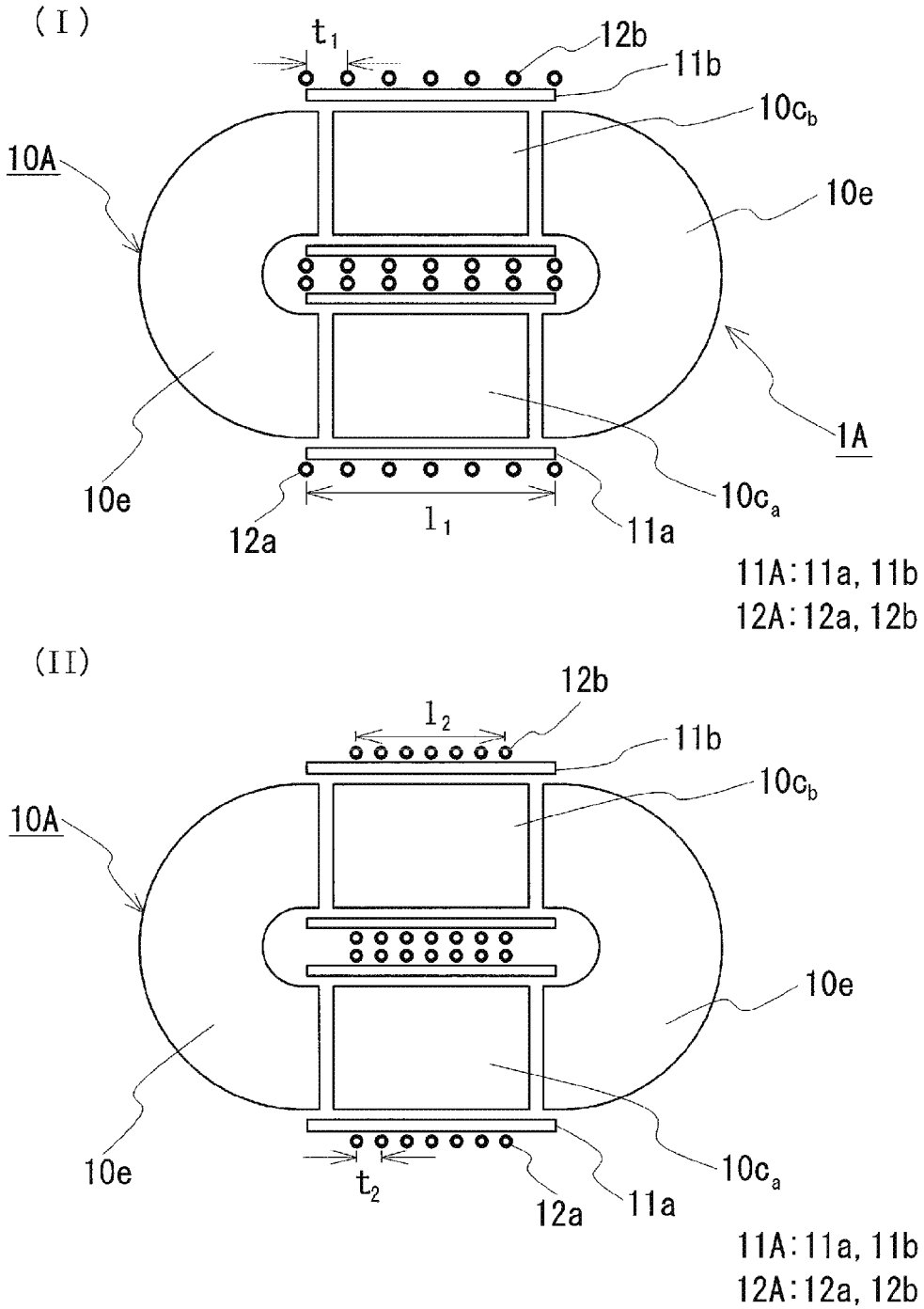
FIG. 3 is a schematic explanatory view of the reactor of Embodiment 1; specifically.

On the other hand, in examples illustrated in FIGS. 1 and 3(II), the main coil 11A and the sub-coil 12A are formed such that the number of turns of the sub-coil element 12*a* (12*b*) is smaller than the number of turns of the main coil element 11*a* (11*b*), and that an axial length $l_2$ of the sub-coil element 12*a* (12*b*) is shorter than an axial length of the main coil element 11*a* (11*b*). Further, in these examples, as in the examples illustrated in FIGS. 2(I) and 3(I), the main coil elements 11*a* and 11*b* and the sub-coil elements 12*a* and 12*b* are arranged around the inner core portions $\mathbf{10}c_a$ and $\mathbf{10}c_b$ such that center positions of the main coil elements 11*a* and 11*b* in the axial direction are aligned with center positions of the sub-coil elements 12*a* and 12*b* in the axial direction, respectively. In these example, therefore, end surfaces of the main coil element 11*a* (11*b*) are shifted from corresponding end surfaces of the sub-coil element 12*a* (12*b*) in the axial direction. In these examples, all the turns constituting the sub-coil element 12*a* (12*b*) are also arranged over the outer periphery of the main coil element 11*a* (11*b*) in overlapped relation.

Thus, various layered forms can be obtained by selecting the number of turns, the spacing between the turns, and the axial length of each of the main coil 11A and the sub-coil 12A as appropriate.

[Insulator]

By disposing an insulator 14 (FIG. 4) between the magnetic core 10A and the main coil 11A, electrical insulation between the magnetic core 10A and the main coil 11A can be enhanced. The insulator 14 includes, for example, sleeve-like portions 14*b* covering respective outer peripheries of the inner core portions $\mathbf{10}c_a$ and $\mathbf{10}c_b$, and a pair of frame-like portions 14*f* positioned in contact with at least the corresponding end surfaces of the main coil elements 11*a* and 11*b*. As illustrated in FIG. 4, the sleeve-like portions 14*b* are each constructed by a pair of halved split pieces each having a channel (]-like shape, which can be combined into an integral sleeve-like member. With such a construction, the sleeve-like portion 14*b* can easily cover an outer periphery of each inner core portion 10*c*. The frame-like portions 14*f* are each a rectangular frame having a pair of through-holes into which the inner core portions $\mathbf{10}c_a$ and $\mathbf{10}c_b$ are inserted. When one of the frame-like portions 14*f* is provided with a support on which the folded-back portion 11*r* is placed, as illustrated in FIGS. 1 and 4, electrical insulation between the main coil 11A and the magnetic core 10A (i.e., each outer core portion 10*e*) can be enhanced.

The insulator 14 and a later-described sleeve-like bobbin 141 (insulating member, see FIG. 6(II)) can be each formed using an insulating material, e.g., a polyphenylene sulfide (PPS) resin, a polytetrafluoroethylene (PTFE) resin, or a liquid crystal polymer (LCP). In addition, the shape of the insulator 14 can be selected as appropriate.

Alternatively, a coil molded product formed by covering the surroundings of an assembly of the main coil 11A and the sub-coil 12A with resin may be used instead of the insulator. Using the coil molded product can facilitate mounting of the magnetic core 10A with respect to the above-mentioned assembly, and can make the above-mentioned insulator no longer required. The resin used in the coil molded product may be, e.g., an epoxy resin. Moreover, the coil molded product may be prepared in another form where the inner core portion 10*c* is also integrated together with the above-mentioned resin. When that type of coil molded product is used, the reactor can be formed by assembling the outer core portions 10*e* to the coil molded product, thus resulting in higher productivity of the reactor.

[Case or Outer Resin Portion]

The reactor 1A can be constructed in the form where an assembled unit of the magnetic core 10A, the main coil 11A, and the sub-coil 12A is contained in a case (not illustrated) made of a metal, e.g., aluminum, and a potting resin (not illustrated) having electrical insulation is filled in the case. In that form, the outer core portions 10*e* may be fixed to the case by employing fixing members, e.g., band-shaped stays (not illustrated). Also, bolt holes may be formed in the outer core portions 10*e*, and the above-mentioned assembled unit may be fixed to the case by screwing bolts through the bolt holes.

Alternatively, the reactor 1A may be constructed in the form including an outer resin portion (not illustrated), which covers the surroundings of the above-mentioned assembled unit with insulating resin, without including the case. Examples of the resin usable as the outer resin portion include an epoxy resin, an urethane resin, a PPS resin, a polybutylene terephthalate (PBT) resin, an acrylonitrile-butadiene-styrene (ABS) resin, and unsaturated polyester. With the omission of the case, the size of the reactor can be further reduced. Further, by constructing the outer resin portion so as to expose a part of the magnetic core and parts of the coils, particularly, an installation surface positioned on a cooling base side in the above-mentioned assembled unit when the reactor is installed on a cooling base, heat of the magnetic core and the coils can be easily dissipated to the cooling base, etc., thus providing the reactor with a superior heat dissipation effect. Moreover, in the form including the outer resin portion without including the resin, the end portions of the wires of the main coil and the sub-coil can be easily led out to desired positions, and a degree of freedom in designing connection positions of the terminal members can be increased.

Additionally, both the end portions of the wires of the main coil and the sub-coil are exposed through the potting resin and the outer resin portions such that the terminal members can be connected to the end portions, or that the terminal members can be connected to each other.

By employing the above-described form where the assembled unit of the magnetic core 10A, the main coil 11A, and the sub-coil 12A is contained in the case, or in which the outer resin portion is molded around the assembled unit, the magnetic core 10A, the main coil 11A, and the sub-coil 12A can be protected against external environments and mechanical damages, and the assembled unit can be more easily handled. The case and the outer resin portion can be similarly applied to other Embodiments and Modifications, which will be described later.

[Assembly of Reactor]

The reactor 1A having the above-described construction can be formed as follows. The following description is made by referring to FIG. 4 as required.

First, the inner core portions $\mathbf{10}c_a$ and $\mathbf{10}c_b$ are formed by fixing the core pieces and the gap members together with, e.g., an adhesive, and each sleeve-like portion 14*b* of the insulator 14 is arranged around each of the inner core portions $\mathbf{10}c_a$ and $\mathbf{10}c_b$. The main coil element 11*a* of the main coil 11A, which is separately fabricated by winding the coated rectangular wire, is arranged over the inner core portion $\mathbf{10}c_a$ including the sleeve-like portion 14*b*, and the main coil element 11*b*, which is also separately fabricated, is arranged over the inner core portion $\mathbf{10}c_b$ including the sleeve-like portion 14*b*.

Next, one frame-like portion 14*f* of the insulator 14 and one outer core portion 10*e* are held in contact with respective one end surfaces of the main coil elements 11*a* and 11*b*, and the other frame-like portion 14*f* of the insulator 14 and the other outer core portion 10*e* are held in contact with respective other end surfaces of the main coil elements 11*a* and 11*b*. Further, the frame-like portions 14*f* and the outer core portions 10*e* are arranged such that the main coil elements 11*a* and 11*b* are sandwiched between both the outer core portions 10*e*. In such a state, the outer core portions 10*e* and the inner core portions $\mathbf{10}c_a$ and $\mathbf{10}c_b$, the latter being exposed through the through-holes of the frame-like portions 14*f*, are bonded to each other using, e.g., an adhesive. With that step, a pre-assembly of the annular magnetic core 10A and the main coil

11A is formed. The folded-back portion 11*r* is placed on the support of the frame-like portion 14*f*.

After the sub-coil element 12*a* is formed by winding a coated electric wire around one main coil element 11*a*, the coated electric wire is led to the side including the other main coil element 11*b*, and the sub-coil element 12*b* is formed by winding the same coated electric wire around the other main coil element 11*b*. At that time, the coated electric wire may be wound such that the spacing between the adjacent turns of each of the sub-coil elements 12*a* and 12*b* is wider than the spacing between the adjacent turns of each of the main coil elements 11*a* and 11*b*. Alternatively, after winding the coated electric wire in a state where the adjacent turns of each of the sub-coil elements 12*a* and 12*b* are contacted with each other, the spacing between those adjacent turns may be widened such that the spacing between the adjacent turns of each of the sub-coil elements 12*a* and 12*b* is wider than the spacing between the adjacent turns of each of the main coil elements 11*a* and 11*b*. The spacing between the adjacent turns in each of the sub-coils may be widened to the desired size. With that step, an assembled unit including a coil assembly, in which the sub-coil 12A is concentrically arranged around the main coil 11A, and the magnetic core 10A can be formed as illustrated in FIGS. 1 and 3.

Terminal members are attached to the end portions 11*e* of the wire 11*w* forming the main coil elements 11*a* and 11*b* and to the end portions 12*e* of the wire 12*w* forming the sub-coil elements 12*a* and 12*b*, the main coil elements 11*a* and 11*b* and the sub-coil elements 12*a* and 12*b* being concentrically arranged. Further, one of the end portions 11*e* of the wire 11*w* and one of the end portions 12*e* of the wire 12*w* are connected to each other through the terminal members. With that step, the reactor 1A including the assembled unit of the annular magnetic core 10A, the main coil 11A, and the sub-coil 12A is formed.

As an alternative, the reactor 1A may be formed as follows. After separately fabricating the sub-coil, the sub-coil elements 12*a* and 12*b* are arranged respectively over the main coil elements 11*a* and 11*b* to form a coil assembly of a layered structure, and the inner core portions $\mathbf{10}c_a$ and $\mathbf{10}c_b$, around each of which the sleeve-like portion 14*b* of the insulator 14 is arranged, are arranged respectively in the main coil elements 11*a* and 11*b* of the coil assembly. The reactor 1A can be then formed by sandwiching the above-mentioned assembly including the inner core portion 10*c* between the frame-shaped portions 14*f* of the insulators 14 and between the outer core portions 10*e*. When forming the above-described coil assembly of the layered structure, in order to avoid the end portions 11*e* of the wires 11*w*, which form the main coil elements 11*a* and 11*b*, from interfering with the operation of assembling the sub-coil 12A, it is advantageous, for example, to extend the end portions 11*e* in the axial direction of the main coil elements 11*a* and 11*b* such that the end portions 11*e* do not project from the outer peripheries of the turns of the main coil elements 11*a* and 11*b*. Further, after assembling the sub-coil elements 12*a* and 12*b* around the main coil elements 11*a* and 11*b*, respectively, the end portions 11*e* of the wires 11*w* are advantageously bent, as appropriate, for easier attachment of the terminal members and easier connection to the sub-coil elements. Alternatively, when assembling the sub-coil elements 12*a* and 12*b* around the main coil elements 11*a* and 11*b*, respectively, the sub-coil elements 12*a* and 12*b* may be slightly deformed and, after assembling the sub-coil elements 12*a* and 12*b*, they may be reshaped.

The reactor 1A in the form including the case or the form including the outer resin portion is assembled by placing the assembled unit of the magnetic core 10A and the coils, which has been obtained as described above, in the case and filling the potting resin into the case, or by covering the surroundings of the assembled unit with the outer resin portion.

Test Example 1

The leakage inductance was determined by simulation when the spacing t between the adjacent turns of the sub-coil was changed.

In this test, the leakage inductance was determined when the spacing t between the adjacent turns of each sub-coil element concentrically layered around the main coil element was changed, on condition that, in one pair of the main coil elements of the main coil, the spacing $t_i$ between the adjacent turns of each main coil element is substantially 0 (here $t_i$=0.1 mm). In this test, the number of turns of each sub-coil element was set to 10, and the number of turns of each main coil element was set to 60. While keeping those numbers of turns constant, as illustrated in FIG. 3, a spacing $t_n$ (n=1, 2, . . . ) in each of both the sub-coil elements was changed, and an axial length $l_n$ (n=1, 2, . . . ) in each of both the sub-coil elements was changed. The spacings t in both the sub-coil elements of one sub-coil were set equal to each other.

The leakage inductance was determined when a current of 1 A was supplied to only the main coil in a state where the pair of sub-coil elements were short-circuited. The results are indicated in Table I.

As compared with the layered form described above, a reactor 1*z* was prepared which had a structure (hereinafter referred to as a "longitudinally end-to-end arranged form") in which, as illustrated in FIG. 2(II), a main coil 110*z* and a sub-coil 120*z* were coaxially arranged adjacent to each other. As in the reactor 1A of Embodiment 1, the reactor 1*z* includes a magnetic core 100*z* having a pair of inner core portions $\mathbf{100}c_a$ and $\mathbf{100}c_b$ and a pair of outer core portions 10*e*, a main coil 110*z*, and a sub-coil 120*z*. Stated another way, similarly to the reactor 1A of Embodiment 1, the reactor 1*z* includes the magnetic core 100*z* in common to the main coil 110*z* and the sub-coil 120*z*.

The main coil 110*z* includes a pair of main coil elements 111*a* and 111*b*, and the sub-coil 120*z* includes a pair of sub-coil elements 120*a* and 120*b*. One main coil element 111*a* and one sub-coil element 120*a* are arranged adjacent to each other over one inner core portion $\mathbf{100}c_a$, and the other main coil element 111*b* and the other sub-coil element 120*b* are arranged adjacent to each other over the other inner core portion $\mathbf{100}c_b$. In other words, the main coil elements 111*a* and 111*b* and the sub-coil elements 120*a* and 120*b* are arranged over the magnetic core 100*z* in a state where all turns constituting the sub-coil 120*z* are not overlapped with the main coil 110*z*. Further, the main coil elements 111*a* and 111*b* and the sub-coil elements 120*a* and 120*b* are arranged over the inner core portions $\mathbf{100}c_a$ and $\mathbf{100}c_b$, respectively, in a state where a gap providing an appropriate distance w is formed between the main coil element 111*a* (111*b*) and the sub-coil element 120*a* (120*b*). With the presence of the gap w, one part of magnetic fluxes generated by both the coils 110*z* and 120*z* flows through the magnetic core 100*z* and the other part leaks between both the coils 110*z* and 120*z*, as denoted by one-dot-chain lines in FIG. 2(II) (each arrow illustrates the direction of the magnetic flux). The leakage inductance specified by the leakage magnetic flux attributable to one of the main coil 110*z* and the sub-coil 120*z* is obtained by adjusting the distance w of the gap (i.e., a length of the gap in the coil axial direction). Further, a coupling coefficient k between both the coils 110*z* and 120*z* can be changed by adjusting the distance w.

Because of including one magnetic core 100z in common to the main coil 110z and the sub-coil 120z, the reactor 1z in longitudinally end-to-end arranged form also has a smaller installation area and a smaller size than when the smoothing reactor and the resonance reactor are disposed separately from each other. Further, because the main coil 110z and the sub-coil 120z are both arranged over the inner core portions, the reactor 1z can have a smaller installation area than, for example, when the main coil 110z is arranged over the inner core portions and the sub-coil 120z is arranged over the outer core portions 10e. In addition, with the reactor 1z in the longitudinally end-to-end arranged form, both the coils 110z and 120z can be easily arranged over the magnetic core 100z, and higher productivity can be obtained.

Here, the number of turns of each main coil element in the reactor 1z was set to 60, the number of turns of each sub-coil element was set to 10, and the spacing between the adjacent turns of all the coil elements was set to be substantially 0 (here $t_i$=0.1 mm). Further, the distance w of the gap was adjusted to provide the coupling coefficient k of 0.9 between both the coils 110z and 120z, and the leakage inductance was measured under the same conditions as those for the above-described reactor in the layered form. The results are also indicated in Table I.

TABLE I

| Sample No. | Spacing t between turns (mm) | Leakage inductance (μH) |
|---|---|---|
| 1-1 | 0.3 mm (FIG. 3(II): $t_2$) | 2 |
| 1-2 | 0.5 mm | 1.6 |
| 1-3 | 1.0 mm (FIG. 3(I): $t_1$) | 1.2 |
| Comparative (longitudinally end-to-end arranged form) | — | 5 |

As seen from Table I, the reactor in the layered form where the main coil and the sub-coil are concentrically arranged has a smaller leakage inductance than the reactor in the longitudinally end-to-end arranged form. In particular, it is seen that as the spacing t between the adjacent turns in each sub-coil element of the sub-coil increases in comparison with the spacing between the adjacent turns of in each main coil element of the main coil, the leakage inductance can be more effectively reduced. Moreover, it is seen that various values of the leakage inductance can be obtained by changing the spacing t between the adjacent turns in each sub-coil element, or by changing the layout of the main coil and the sub-coil.

[Advantageous Effects]

When the reactor 1A is assembled as a component of a two-way DC-DC converter, the reactor 1A can perform not only step-up and step-down operations with the provision of the main coil 1A, but also soft switching in the step-up and step-down operations with the provision of the sub-coil 1B, thereby reducing a loss attributable to the switching operation. In particular, because of sharing one magnetic core 10A by both the coils 11A and 12A, the reactor 1A has a smaller size than when the resonance reactor and the smoothing reactor are separate members. Further, because the main coil elements 11a and 11b of the main coil 11A and the sub-coil elements 12a and 12b of the sub-coil 12A in the reactor 1A are concentrically arranged over the inner core portions $\mathbf{10}c_a$ and $\mathbf{10}c_b$ of the annular magnetic core 10A, respectively, the reactor 1A has a shorter axial length than, for example, the reactor in which the resonance coil is arranged over the outer core portion 10e, or the reactor in the longitudinally end-to-end arranged form illustrated in FIG. 2(II). This also contributes to reducing the size of the reactor 1A.

Moreover, the leakage inductance of the reactor 1A in the layered form is smaller than that of the reactor in the longitudinally end-to-end arranged form illustrated in FIG. 2(II). In particular, the leakage inductance of the reactor 1A can be further reduced by employing the form where the spacing between the adjacent turns the sub-coil is wider than the spacing between the adjacent turns in the main coil. Therefore, the reactor 1A can be suitably applied to the case where the leakage inductance is desired to be held small. In addition, the leakage inductance of the reactor 1A can be obtained in various values by appropriately adjusting the spacing t between the adjacent turns in the sub-coil, as seen from Text Example 1 described above. The obtained leakage inductance can be utilized, for example, as the inductor Lr for the soft switching. Thus, the reactor 1A can be obtained in the form including the inductor Lr as well, and it has a smaller size than when the inductor Lr is disposed as a separate member.

Besides, in the reactor 1A, since the main coil 11A is formed of the coated rectangular wire, the space factor of the coil can be increased and the axial length of the main coil elements 11a and 11b can be shortened. Further, since the axial length of the sub-coil elements 12a and 12b is comparable to or smaller than that of the main coil elements 11a and 11b, it is not required in the above-described reactor 1A to increase the length of the inner core portions $\mathbf{10}c_a$ and $\mathbf{10}c_b$ of the magnetic core 10A (i.e., the length thereof in the coil axial direction) even with the structure including the sub-coil 12A in addition to the main coil 11A. This further contributes to a size reduction of the reactor 1A.

Moreover, in the reactor 1A, since the sub-coil 12A is constituted by the coated electric wire and has good insulation performance, the insulation between the main coil element 11a (11b) and the sub-coil element 12a (12b) can be sufficiently ensured. Further, since the reactor 1A does not include an additional insulating member interposed between the concentrically arranged coil elements 11a and 12a (11b and 12b), it is possible to reduce the size and the number of components corresponding to the absence of the additional insulating member. Still further, since the sub-coil 12A is constituted by the coated electric wire, the sub-coil elements can be easily formed around the main coil elements by, e.g., manual winding. Therefore, the reactor 1A has higher productivity. In addition, since both the coils 11A and 12A are arranged over only parts of the magnetic core 10A and the magnetic core 10A has exposed regions where the coils are not disposed, the reactor 1A can easily radiate heat of both the coils 11A and 12A through the exposed regions, and it has a superior heat dissipation effect as well.

Embodiment 2

The reactor 1A of Embodiment 1 has been described above in connection with the form where the wire 11w of the main coil 11A and the wire 12w of the sub-coil 12A are made of different materials. The reactor may also be practiced in the form where the wire of the main coil and the wire of the sub-coil are made of similar materials, e.g., a coated electric wire. Because an insulating coating layer of the coated electric wire has superior electrical insulation performance to the coated rectangular wire, sufficient insulation can be obtained between the main coil elements and the sub-coil elements of the reactor in the layered form where the main coil elements and the sub-coil elements are concentrically arranged. In the form of Embodiment 2, therefore, sufficient insulation can be ensured without additionally interposing insulating members between the main coil elements and the sub-coil elements. Using the coated electric wire further enables the coils, which are concentrically arranged, to be easily formed by manual winding, as described above.

Embodiment 3

In an alternative form, the wire of the main coil and the wire of the sub-coil may be both made of coated rectangular wires. In that form, it is particularly easier to obtain the coils, which have higher space factors, by providing both the coils as edgewise coils. Further, by providing both the coils as edgewise coils, when respective one end portions of the wires of both the coils are directly connected to each other by, e.g., welding, a contact area (typically, a welding area) can be sufficiently ensured, and one terminal member can be attached in common to the connected one end portions. As a result, it is possible to reduce the number of terminal members and the number of steps of attaching the terminal members.

In this embodiment, when an amount of current supplied to the sub-coil is comparatively small, a cross-sectional area of a conductor of the wire (here, a rectangular wire) forming the sub-coil can be reduced. For example, when a width of the coated rectangular wire constituting the sub-coil and a width of the coated rectangular wire constituting the main coil are set equal to each other, the coated rectangular wire constituting the sub-coil can be made of a wire having a conductor in a smaller thickness. Since the coated rectangular wire (conductor) constituting the main coil and the coated rectangular wire (conductor) constituting the sub-coil have the same width, a contact area between them can be sufficiently ensured.

In the reactor in the layered form, when the wire of the main coil and the wire of the sub-coil are both coated rectangular wires, a difficulty may occur in an operation of arranging the sub-coil around the main coil because of interference with the end portions of the wire of the main coil. The assembly operation can be facilitated, for example, by extending the end portions of the wire of the main coil in the axial direction of the sub-coil, as described above, before assembling the sub-coil to the main coil.

Further, in the reactor in the layered form, when the wire of the main coil and the wire of the sub-coil are both made of coated rectangular wires, a difficulty may occur in the operation of arranging the sub-coil around the main coil if both the coils are continuous coils having folded-back portions. The sub-coil can be easily arranged around the main coil, for example, by forming the folded-back portion of the sub-coil to be slightly raised externally of the main coil, or by employing, as at least one of the main coil and the sub-coil, a joined coil in which the coil elements of the one coil are formed of separate wires and are integrated with each other. While respective one end portions of the wires of the coil elements can be joined to each other, for example, by employing an additional plate member for connection, the number of joined points and the number of joining steps can be reduced by directly connecting the above-mentioned one end portions with, e.g., welding. When the one end portions are directly connected to each other, the connecting operation can be facilitated by, e.g., bending at least one of the wires, as appropriate, into such a shape that the end portions of the wires of both the coil elements are positioned as close as possible to each other. Further, the operation of arranging the sub-coil is facilitated by performing the operation of connecting the main coil elements to each other after the sub-coil has been arranged around main coil.

In Embodiments 1 and 2, at least one of the main coil and the sub-coil may be constituted as the above-described joined coil. When the coated electric wire is used as the wire as in Embodiment 2, it is preferable that terminal members are connected to respective end portions of wires of the coil elements of the main coil (or the sub-coil) and those coil elements are connected to each other through those terminal members.

Besides, in the reactor in the layered form, when the wire of the main coil and the wire of the sub-coil are both made of coated rectangular wires, the electrical insulation between the main coil and the sub-coil in the layered state can be enhanced by positioning an insulating member, such as insulating paper 140 (see FIG. 6(I) described later) or a sleeve-like bobbin 141 (see FIG. 6(II) described later) made of an insulating material, between the main coil and the sub-coil. Because the insulating paper 140 is comparatively thin, the use of the insulating paper 140 does not excessively increase the size of the assembly of the concentrically arranged main coil and sub-coil in the layered direction, whereby the size of the reactor can be held small. Further, the insulating paper 140 is comparatively inexpensive, and the material cost can be held low. On the other hand, the sleeve-like bobbin 141 can be made of a similar material to that of the above-described insulator 14, and can be selectively formed in an appropriate shape and thickness. Further, the sleeve-like bobbin 141 can be easily arranged around the main coil by forming the bobbin 141 in a combined structure (see FIG. 6(III) described later) of split pieces as in the sleeve-like portion 14*b* of the above-described insulator 14. Moreover, by providing, on the bobbin 141, a positioning portion (e.g., a projection or a groove) to position at least one of the main coil and the sub-coil, the coils can be easily arranged in place because the positioning of the coils with respect to the bobbin 141 is facilitated. Accordingly, the reactor can be easily assembled.

In the reactors of Embodiments 1 and 2, too, the electrical insulation between the main coil and the sub-coil can be further enhanced, as described above, by providing the insulating paper 140 or the bobbin 141.

In the reactor in the layered form, the sub-coil elements of the sub-coil may be each a flatwise coil that is obtained by winding a coated rectangular wire in a flatwise manner. In that case, the height of the sub-coil (i.e., the size of the sub-coil in a direction perpendicular to both the axial direction of the coil and the direction in which the pair of the sub-coil elements are arranged side by side) and the width of the sub-coil (i.e., the size of the sub-coil in the direction in which the pair of the sub-coil elements are arranged side by side) can be reduced in comparison with the case where the sub-coil is formed as an edgewise coil. Accordingly, the size of the reactor can be further reduced by employing the sub-coil formed as a flatwise coil. Moreover, with the number of turns of the sub-coil set to be smaller than that of the main coil, the axial length of the sub-coil can be reduced even in the state where the spacing between the adjacent turns of the sub-coil is wider. As a result, even when the sub-coil is formed as the flatwise coil, the length of the sub-coil is avoided from excessively increasing, and the size of the reactor can be held small.

Embodiment 4

Alternatively, the wires constituting the main coil and the sub-coil may be each made of a wire 13*w* that is a coated round wire having an insulating coating layer (typically, an enamel coating) 13*i* coated on an outer periphery of a conductor 13*c* in the form of a copper-made round wire, as illustrated in FIG. 5(III). The coated round wire can provide a coil having a higher space factor than a coil formed of the coated electric wire. In addition, the coated round wire is softer than the coated electric wire, and it can be more easily wound by manual winding.

It is also possible to use the coated round wire instead of the coated rectangular wire constituting the main coil in Embodiment 1, to use the coated round wires as the wires constituting both the main coil and the sub-coil, or to constitute one of the main coil and the sub-coil by the coated rectangular wire or the coated electric wire and to constitute the other coil by the coated round wire.

When only the coated round wire is used as the wires constituting both the main coil and the sub-coil, or when the coated round wire and the coated rectangular wire are used as illustrated in FIG. 6, i.e., when the coated electric wire illustrated in FIG. 5(II) is not used, the insulation between the main coil 11A and the sub-coil 12B can be enhanced, for example, by arranging the insulating paper 140 between each of the main coil elements 11*a* and 11*b* of the main coil 11A and each of sub-coil elements 12*a* and 12*b* of the sub-coil 12B, the main coil 11A and the sub-coil 12B being concentrically arranged in the layered form, as in a reactor 1B illustrated in FIG. 6(I), or by arranging the sleeve-like bobbin 141 between each of the main coil elements 11*a* and 11*b* of the main coil 11A and each of the sub-coil elements 12*a* and 12*b* of the sub-coil 12B, the main coil 11A and the sub-coil 12B being concentrically arranged in the layered form, as in a reactor 1C illustrated in FIG. 6(II).

Embodiment 5

Alternatively, the wire may be in the form of a sheet-like wire that is obtained by laminating an insulating coating layer (e.g., polyimide with a thickness of 0.2 mm) on the surface of a conductor (e.g., a thickness of 0.1 mm×width of 1.0 mm) made of a copper foil. The conductor of the sheet-like wire has a smaller cross-sectional area and a smaller thickness than that of the coated rectangular wire described above. Accordingly, a coil using the sheet-like wire can also be reduced in height and width as in the above-described flatwise coil. Thus, the size of the reactor can be further reduced by utilizing the coil of the sheet-like wire. In particular, when an amount of current supplied to the sub-coil during use is small, e.g., when the reactor is used as a resonance reactor, the sheet-like wire can be used as the wire forming the sub-coil.

Embodiment 6

In the embodiments described above, the conductors 11*c*, 12*c* and 13*c* of the wires 11*w*, 12*w* and 13*w*, and the conductor of the sheet-like wire are made of copper. When an amount of current supplied to the sub-coil during use is small, e.g., when the reactor is used as a resonance reactor, the conductor of the wire constituting the sub-coil may be made a copper alloy, aluminum, or an aluminum alloy, which has smaller electrical conductivity than copper. The weight of the reactor can be reduced by employing, as the wire of the sub-coil, a wire having a conductor made of aluminum or an aluminum alloy.

Embodiment 7

The reactor 1A of Embodiment 1 has been described above as attaching the terminal member to each of both end portions 11*e* of the wire 11*w* of the main coil 11A and both end portions 12*e* of the wire 12*w* of the sub-coil 12A, i.e., as including four terminal members in total. In another form, one end portion 11*e* of the wire 11*w* of the main coil 11A and one end portion 12*e* of the wire 12*w* of the sub-coil 12A may be directly joined to each other.

Respective conductors of the wires 11*w* and 12*w* can be directly joined to each other by welding, e.g., TIG welding, laser welding or resistance welding, or by pressure bonding, cold pressure welding, or vibration welding. In particular, when at least one of the wire forming the main coil and the wire forming the sub-coil is the coated rectangular wire, the operation of joining both the coils is facilitated because a sufficient contact area can be ensured in the joining operation. This point contributes to increasing productivity of the reactor. Further, by directly joining respective one end portions of the wires of the main coil and the sub-coil to each other, one terminal member can be used in common to both the one end portions, and the number of terminal members and the number of steps of attaching the terminal members can be reduced. As a result, assembly workability of the reactor can be increased. The reactor in this form includes three terminal members in total.

Embodiment 8

Figure 7:
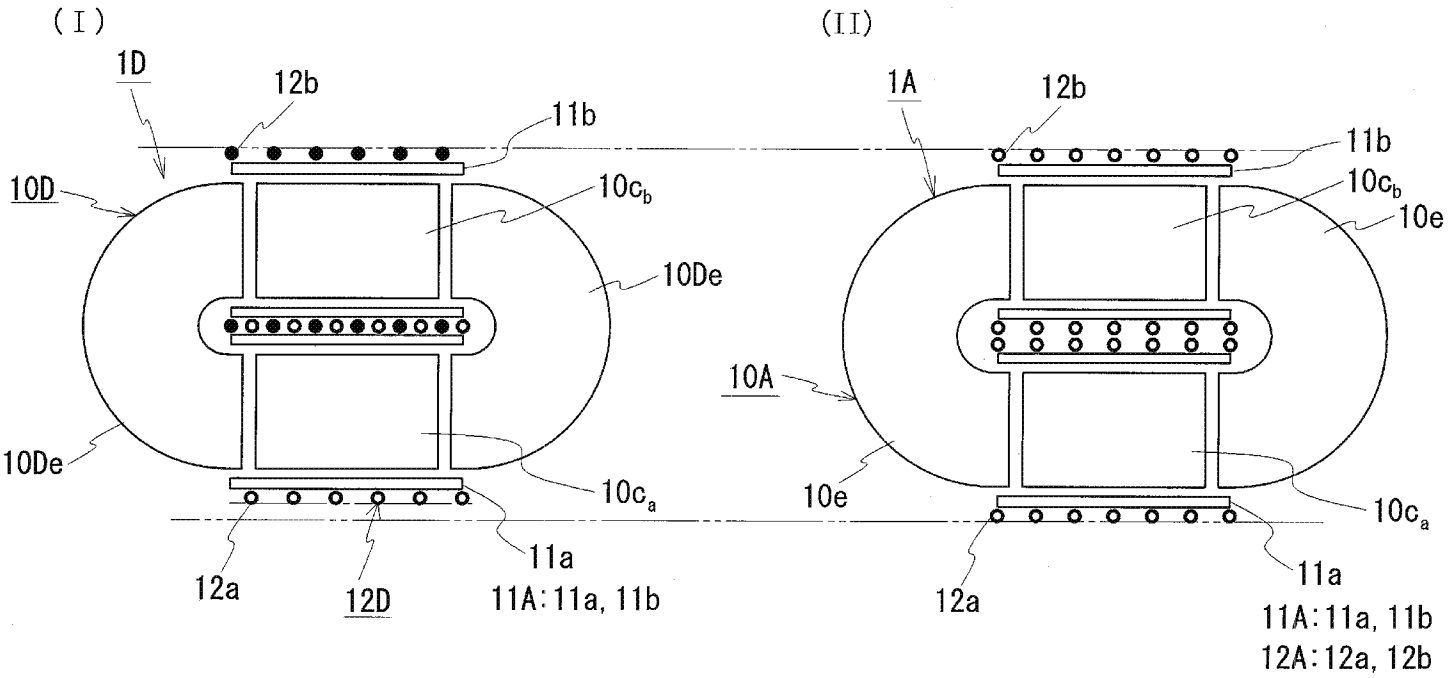
FIG. 7 is a schematic explanatory view to explain the layout of an annular magnetic core and coils, both constituting a reactor; specifically.
Figure 8:
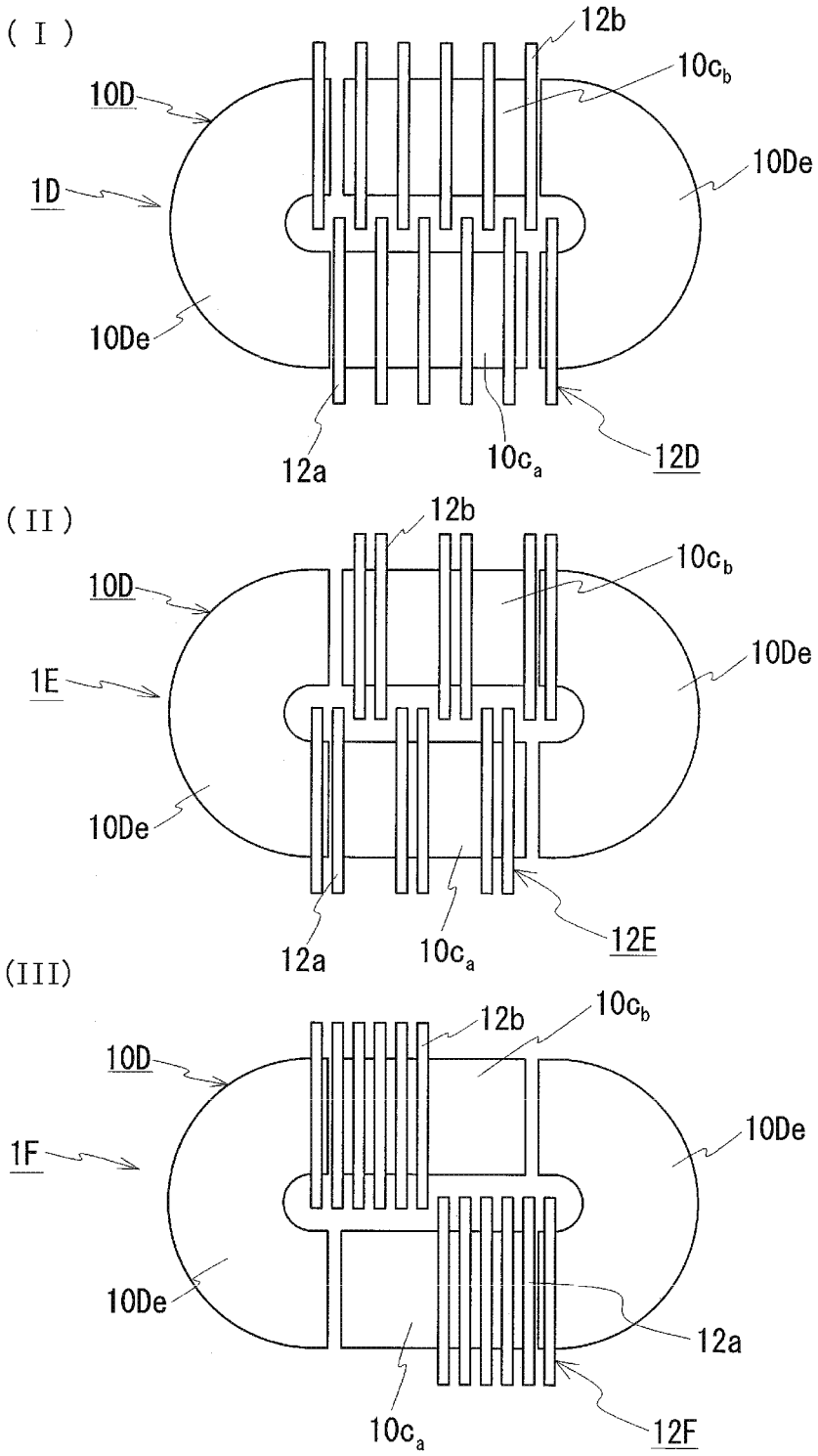
FIG. 8 is a schematic explanatory view to explain the wire layout of the sub-coil; specifically.

Reactors 1D to 1F of Embodiment 8 will be described below by referring to FIGS. 7 and 8 as required. In FIG. 7(I), one sub-coil element 12*b* is denoted by black solid circles for easier understanding. In FIG. 8, only a magnetic core and a sub-coil are illustrated with omission of the other components.

In the reactor 1A (FIG. 7(II)) of Embodiment 1 described above, the wires in the opposed portions of the turns forming the sub-coil elements 12*a* and 12*b* of the sub-coil 12A, i.e., the wires arranged between the inner core portions $\mathbf{10}c_a$ and $\mathbf{10}c_b$ of the magnetic core 10A, which are disposed side by side in the transverse direction, are arranged adjacent to each other in the transverse direction. In an alternative form, as in the reactor 1D illustrated in FIGS. 7(I) and 8(I), the wires in the opposed portions of the turns forming the sub-coil elements 12*a* and 12*b* of the sub-coil 12A, i.e., the wires arranged between the inner core portions $\mathbf{10}c_a$ and $\mathbf{10}c_b$, may be arranged in a state overlapped in the axial direction of the sub-coil elements 12*a* and 12*b*.

In the reactor 1D of this embodiment, the wire forming the turns of one sub-coil element 12*a* and the wire forming the turns of the other sub-coil element 12*b* are alternately arranged one turn by one turn. Stated another way, a sub-coil 12D of the reactor 1D is constructed such that, between the adjacent turns forming the one sub-coil element 12*a*, the turns forming the other sub-coil element 12*b* are each inserted. As illustrated in FIG. 7(I), the wires of both the sub-coil elements 12*a* and 12*b* arranged between the inner core portions $\mathbf{10}c_a$ and $\mathbf{10}c_b$ are positioned on one linear line.

Thus, since the wires of both the sub-coil elements 12*a* and 12*b* are arranged in overlapping relation in the axial direction of the sub-coil, the spacing between the inner core portions $\mathbf{10}c_a$ and $\mathbf{10}c_b$ in the reactor 1D can be set narrower than that in the reactor 1A illustrated in FIG. 7(II). Accordingly, the width (i.e., the size in the direction (vertical direction in FIG. 7) perpendicular to the coil axial direction) of each outer core portion 10*e* of the magnetic core 10D in the reactor 1D can be set smaller than that of each outer core portion 10*e* of the magnetic core 10A in the reactor 1A. Hence the reactor 1D has a smaller size than the reactor 1A. The sub-coil 12D can be easily formed by manually winding the wire as described in Embodiment 1, or by employing the joined coil as described in Embodiment 3. In particular, when the spacing between the adjacent turns is wide in each of the sub-coil elements 12*a* and 12*b*, it is easy to position, between the adjacent turns of the one sub-coil element 12*a*, each of the turns of the other sub-coil element 12*b*. Further, in this embodiment, since the spacing between the adjacent turns is even for all of the adjacent turns constituting both the sub-coil elements 12*a* and 12*b*, it is easier to evenly position, between the adjacent turns of the one sub-coil element 12*a*, each of the turns of the other sub-coil element 12*b*.

In addition to the form where the wire forming the turns of one sub-coil element 12*a* and the wire forming the turns of the other sub-coil element 12*b* are alternately arranged one turn by one turn as described above, those wires may be alternately arranged in units of plural turns (here, two turns) as in a reactor 1E illustrated in FIG. 8(II). In that form, since the spacing between the adjacent turn units in each of sub-coil elements 12*a* and 12*b* of a sub-coil 12E is wider than that in the sub-coil 12D of the reactor 1D, it is expected that the leakage inductance can be further reduced.

Alternatively, as in a reactor 1F illustrated in FIG. 8(III), an end surface of one sub-coil element 12*a* of a sub-coil 12F and an end surface of the other sub-coil elements 12*b* may be arranged in overlapping relation to each other. In that form, the number of points where both the sub-coil elements 12*a* and 12*b* are overlapped with each other in the axial direction of the sub-coil is reduced. Accordingly, it is not necessary to alternately arrange the wire of one sub-coil element 12*a* and the wire of the other sub-coil element 12*b* one turn by one turn or in units of plural turns unlike the reactors 1D and 1F. Hence the reactor 1F can be more easily formed.

Embodiment 9

The reactor 1A of Embodiment 1 has been described in connection with the form where respective center positions of the main coil 11A and the sub-coil 12A in the coil axial direction are the same. The leakage inductance can be changed by not only arranging the adjacent turns of the sub-coil 12A in the state relatively widened therebetween, but also shifting the axial center position of the main coil and the axial center position of the sub-coil from each other in the axial direction.

In this embodiment, the length of the main coil (sub-coil) in the axial direction can be reduced in the assembly of the main coil and the sub-coil by appropriately adjusting the number of turns of the sub-coil, the spacing between the turns of the sub-coil, a shift amount between the center positions of the main coil and the sub-coil, etc. For example, by reducing the number of turns of the sub-coil, narrowing the spacing between the turns of the sub-coil, or reducing the shift amount, the above-mentioned assembly is avoided from becoming too long, and the length of the inner core portions can be easily shortened.

The assembly of the main coil and the sub-coil having the center positions shifted from each other in the axial direction can be formed, for example, as follows. When the main coil is constituted by the coated rectangular wire and the sub-coil is constituted by the coated electric wire as in the reactor 1A of Embodiment 1, the sub-coil elements are formed respectively around the main coil elements at arbitrary positions by winding the coated electric wires around the main coil elements in a similar manner to the case of forming the reactor 1A of Embodiment 1. In an alternative manner, the main coil and the sub-coil are separately formed, and the sub-coil elements are assembled respectively over outer peripheries of the main coil elements at arbitrary positions. Then, each sub-coil element is moved in the axial direction to relatively shift the axial center position of the main coil element and the axial center position of the sub-coil element so that the desired leakage inductance is obtained, i.e., that the desired shift amount is provided. With appropriate adjustment of the shift amount, the assembly of both the main coil and the sub-coil having the center positions relatively shifted from each other can be formed. By forming the assembly of both the coils as described above, the reactor including that assembly can be formed.

The shift amount is advantageously selected as appropriate on the basis of relational data, described below, which is prepared in advance. The relational data is obtained, for example, as follows. Reactors in various specifications are fabricated in appropriate combinations of main coils and sub-coils in which the cross-sectional area of the wire, the number of turns, the axial length of the coil, the spacing between the adjacent turns, etc. are changed. For each of the fabricated reactors, the leakage inductance is measured when the center positions of the main coil and the sub-coil are shifted relative to each other. The relational data is then obtained by determining the relation between the shift amount and the leakage inductance.

In particular, when at least one of the main coil and the sub-coil is formed of the coated rectangular wire, the coil shape is hard to deform and is maintained with high retention. Therefore, when the coil formed of the coated rectangular wire is shifted after concentrically arranging the main coil and the sub-coil, the relevant coil can be easily moved.

Further, in the form including the sleeve-like bobbin, described in Embodiment 3, etc., between the main coil and the sub-coil, relative positional relation between both the coils can be easily avoided from deviating from the predetermined positional relation by providing, on the bobbin, a portion for positioning of the main coil and the sub-coil.

Test Example 2

The leakage inductance was determined by simulation when a shift amount 1 of the center position in the axial direction between the main coil and the sub-coil was changed.

Figure 9:
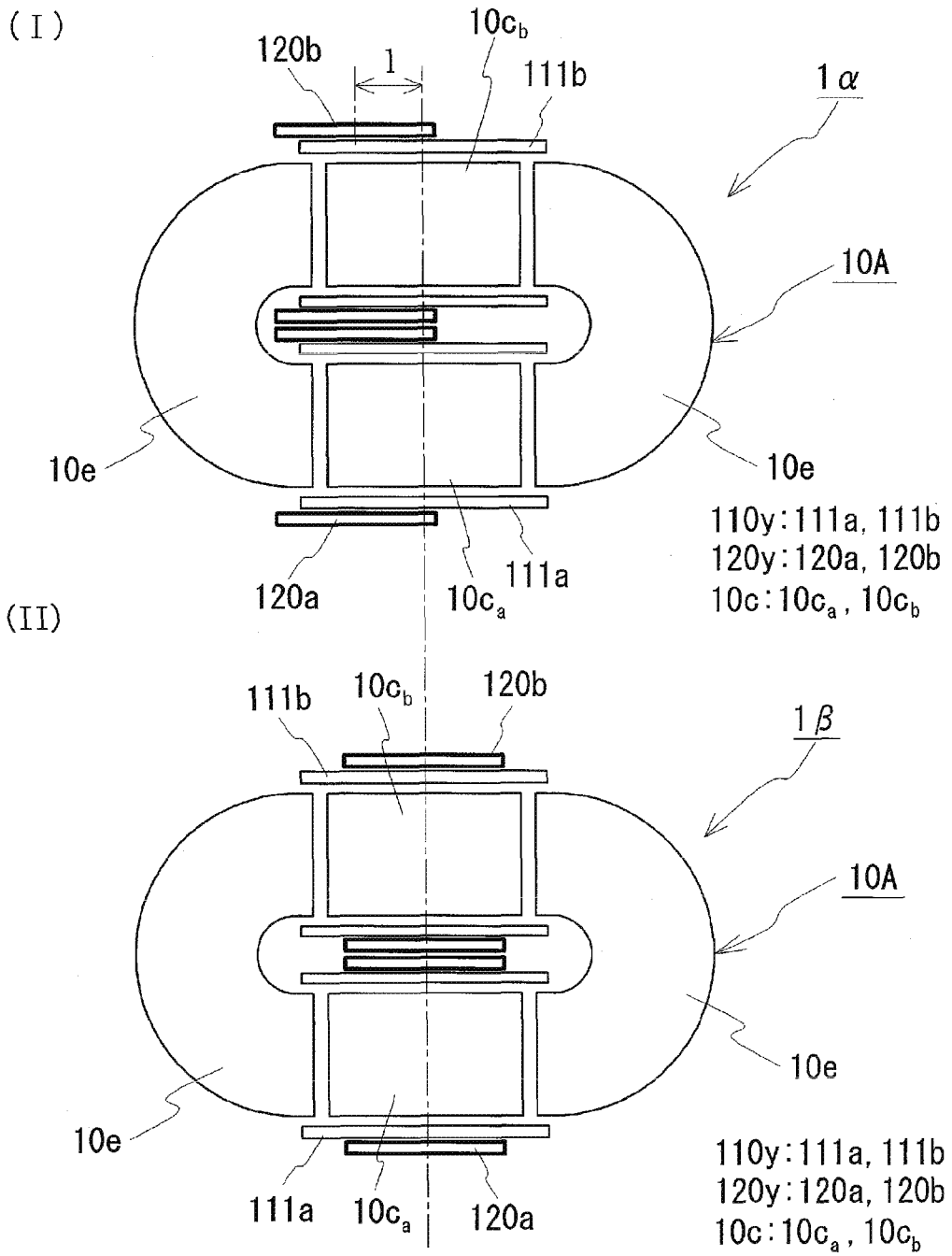
FIG. 9 is a schematic explanatory view to explain the layout of an annular magnetic core and coils, both constituting a reactor used in Test Example 2; specifically.

In this test, the shift amount 1 of a reactor 1β, in which a center position of a main coil element 111*a* (111*b*) of a main coil 110*y* in the axial direction and a center position of a sub-coil element 120*a* (120*b*) of a sub-coil 120*y* in the axial direction are aligned with each other, as illustrated in FIG. 9(II), is defined as 1=0 (mm). Further, a reactor 1α (FIG. 9(I)) having a different shift amount 1 was fabricated and the leakage inductance was determined when the shift amount 1 was changed to various values. More specifically, the number of turns of each sub-coil element was set to 10, and the number of turns of each main coil element was set to 60, those numbers of turns being kept constant. The spacing between adjacent twos of all the turns constituting the main coil elements was set substantially to 0 mm (here, 0.1 mm), and the spacing t between adjacent twos of all the turns constituting the sub-coil elements was set substantially to 0.3 mm. The leakage inductance was then determined when a current of 1 A was supplied to only the main coil in a state where the pair of sub-coil elements were short-circuited. The results are indicated in Table II.

TABLE II

| Sample No. | Shift amount 1 (mm) | Leakage inductance (μH) |
|---|---|---|
| 2-1 | 0 mm | 2 |
| 2-2 | 4 mm | 2.2 |
| 2-3 | 8 mm | 2.8 |
| 2-4 | 12 mm | 4.0 |

As seen from Table II, the leakage inductance can also be changed by, instead of making the spacing between the turns of the main coil and the spacing between the turns of the sub-coil different from each other as in the reactor 1A of Embodiment 1, relatively shifting the center positions of the both coils in the axial direction. Further, it is seen that the leakage inductance can be obtained in various values by adjusting only the shift amount 1. Thus, reactors having various values of the leakage inductance can be formed by not only adjusting the spacing between the turns of the sub-coil, but also by appropriately shifting the center positions of both the coils in the axial direction. It is, therefore, expected to be flexibly adapted for a demand to obtain a reactor, which satisfies the desired resonance frequency and which has a small size.

However, if the leakage inductance is too large, there is a possibility that, in soft switching, a current pulse width may be too increased, for example, to perform the proper soft switching. For that reason, the value of the leakage inductance is preferably adjusted within such a range that the soft switching can be appropriately performed.

Embodiment 10

Figure 10:
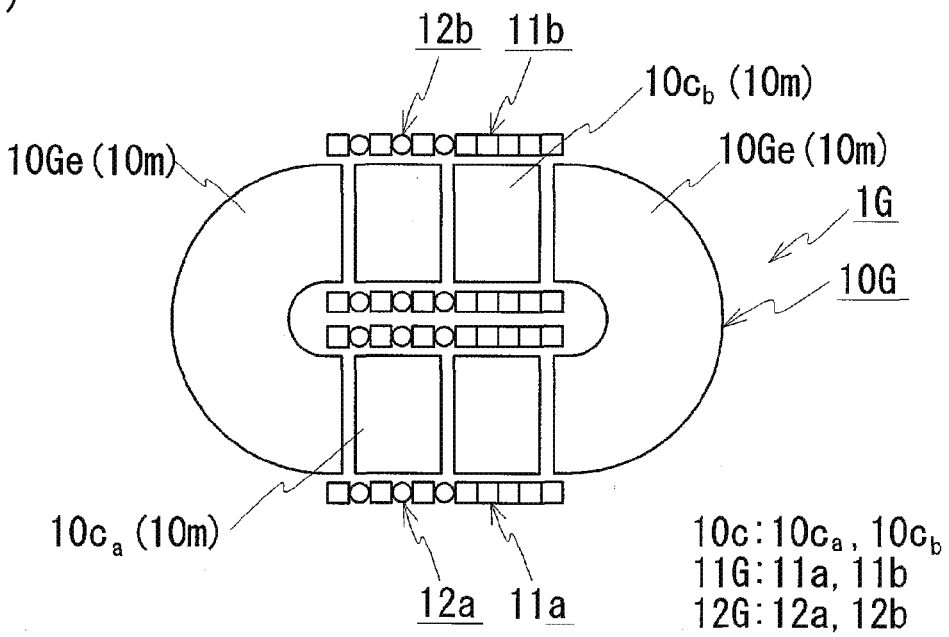
FIG. 10 is a schematic explanatory view to explain the layout of an annular magnetic core and coils, both constituting a reactor of Embodiment 10; specifically.
Figure 10:
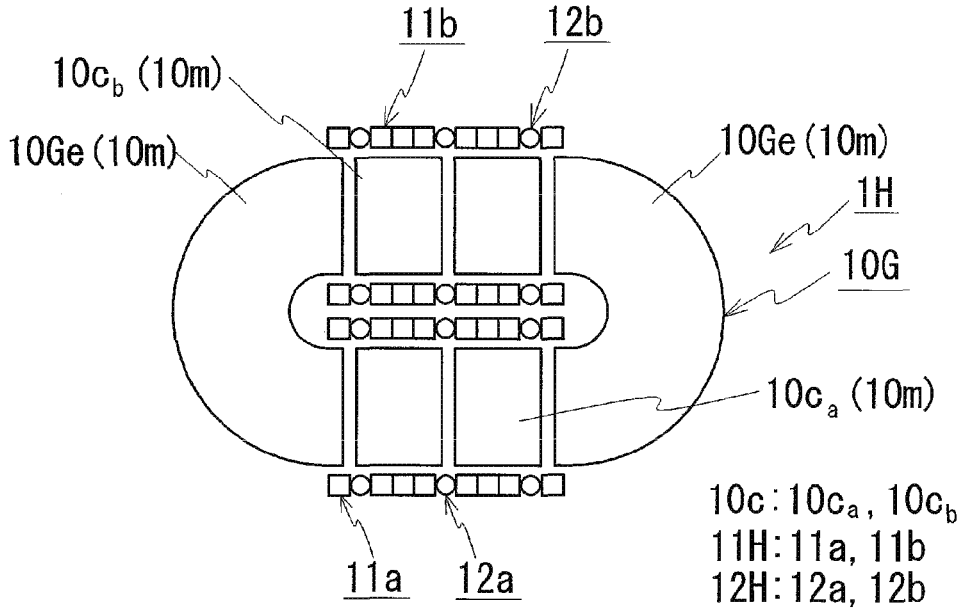

A reactor 1G of Embodiment 10 will be described below with reference to FIG. 10. In FIG. 10 and FIGS. 11 to 13 described subsequently, a main coil is denoted by □ and a sub-coil is denoted by ○. Embodiment 10 represents the reactor constructed in the toroidal form and the interposed form using the coated rectangular wire as the main coil and the coated electric wire as the sub-coil.

As in the reactor in the layered form described above in Embodiments 1 to 9, the reactor 1G of Embodiment 10 include an annular magnetic core 10G having an inner core portion 10*c* and outer core portions 10Ge, a main coil 11G, and a sub-coil 12G, these coils being arranged over the inner core portion 10*c*. The magnetic core 10G and the main coil 11G function as a smoothing reactor, for example. The magnetic core 10G and the sub-coil 12G function as a resonance reactor. The reactor 1G differs from the reactors in the layered form, described above in Embodiments 1 to 9, in the layout of the main coil 11G and the sub-coil 12G. The following description is made primarily about the different point, and detailed description of construction like that in Embodiment 1 is omitted.

[Main Coil]

The main coil 11G includes a pair of main coil elements 11*a* and 11*b*, which are formed by spirally winding one continuous wire (here, a coated rectangular wire) and which are arranged in parallel. The main coil elements 11*a* and 11*b* are edgewise coils having the same number of turns, and the main coil 11G is a continuous coil in which the main coil elements 11*a* and 11*b* are connected to each other through a folded-back portion (not illustrated).

Terminal members are connected to both end portions (not illustrated) of the wire constituting the main coil 11G and to both end portions (not illustrated) of a wire constituting the later-described sub-coil 12G. Further, for example, one of the terminal members connected to the main coil 11G and one of the terminal members connected to the sub-coil 12G are connected to each other using, e.g., a bolt. Alternatively, one end portion of the main coil 11G and one end portion of the sub-coil 12G are directly joined to each other, and one terminal member is attached to the joined portions.

The main coil 11G may be a joined coil. When the continuous coil having the folded-back portion is used, the outer core portion 10Ge of the magnetic core 10G is required to have a region where the folded-back portion is to be arranged. Therefore, the length of the magnetic core 10G in the axial direction tends to increase corresponding to the presence of such a region. As a result, the size of the reactor tends to increase. In contrast, when the joined coil is used, a region where joined portions of the coil elements to be arranged with respect to the magnetic core can be made smaller by appropriately routing the end portions of the wires of the coil elements, whereby the size of the reactor can be further reduced.

[Sub-Coil]

The sub-coil 12G includes a pair of sub-coil elements 12*a* and 12*b*, which are formed by spirally winding one continuous wire (here, a coated electric wire), the wire being different from the wire constituting the main coil 11G, and which are arranged in parallel. In this embodiment, the numbers of turns of the sub-coil elements 12*a* and 12*b* are the same and are each smaller than that of each of the main coil elements 11*a* and 11*b* in the main coil 11G. Additionally, the thickness, the width, and the number of turns of each of the wires constituting both the coils 11G and 12G can be appropriately selected.

[Layout of Both Coils]

One main coil element 11*a* of the main coil 11G and one sub-coil element 12*a* of the sub-coil 12G are arranged around one inner core portion $\mathbf{10}c_a$ of the magnetic core 10G, and the other main coil element 11*b* of the main coil 11G and the other sub-coil element 12*b* of the sub-coil 12G are arranged around the other inner core portion $\mathbf{10}c_b$ of the magnetic core 10G. Further, the turns constituting the sub-coil element 12*a* are each interposed between the turns constituting the main coil element 11*a*. Similarly, the turns constituting the sub-coil element 12*b* are each interposed between the turns constituting the main coil element 11*b*.

In this embodiment, the wire forming each turn of the main coil element 11*a* (11*b*) and the wire forming each turn of the sub-coil element 12*a* (12*b*) are alternately arranged one by one. Stated another way, there are plural positions where the turn of the main coil 11G is interposed between the turns of the sub-coil 12G. Further, in this embodiment, because the number of turns of the sub-coil element 12*a* (12*b*) is smaller than that of the main coil element 11*a* (11*b*), the sub-coil element 12*a* (12*b*) is present only in a part of the main coil element 11*a* (11*b*). Moreover, in a portion of the turns constituting the main coil element 11*a* (11*b*) where the sub-coil element 12*a* (12*b*) is not arranged in a combined state, the spacing between the turns constituting the main coil element 11*a* (11*b*) is substantially not widened. Accordingly, the reactor 1G includes a region where the spacing between the adjacent turns constituting each of the sub-coil elements 12*a* and 12*b* is wider than the spacing between the adjacent turns constituting each of the main coil elements 11*a* and 11*b*. Still further, since the wire of the main coil 11G and the wire of the sub-coil 12G are alternately arranged one turn by one turn as described above, the spacings between adjacent twos of all the turns constituting the sub-coil element 12*a* (12*b*) are even. In addition, since all the turns constituting each of the sub-coil elements 12*a* and 12*b* are sandwiched between parts of each of the main coil elements 11*a* and 11*b*, respectively, the reactor 1G has such a shape that both the coils 11G and 12G are overlapped with each other in the axial direction of the main coil.

Examples illustrated in FIG. 10 represent the form where both ends of an assembly of the main coil 11G and the sub-coil 12G are each provided by the wire constituting the main coil 11G. As an alternative form, one end or both ends of the above-mentioned assembly may be each provided by the wire constituting the sub-coil. Further, the examples illustrated in FIG. 10 represent the form where the center position of the main coil 11G in the axial direction and the center position of the sub-coil 12G in the axial direction are relatively shifted from each other. Alternatively, the main coil 11G and the sub-coil 12G may be assembled with each other such that the center positions of both the coils 11G and 12G are aligned with each other.

The main coil element 11*a* (11*b*) and the sub-coil element 12*a* (12*b*) are assembled over the inner core portion $\mathbf{10}c_a$ ($\mathbf{10}c_b$) and are arranged with their axes lying on one linear line.

[Formation of Coil]

The assembly of the main coil 11G and the sub-coil 12G can be formed as follows. With one exemplary method, after forming the main coil 11G, the wire constituting the sub-coil element 12*a* (12*b*) is wound between the turns of the main coil element 11*a* (11*b*) at the desired position such that each turn of the sub-coil element 12*a* (12*b*) is positioned between the turns of the main coil element 11*a* (11*b*). On that occasion, the wire of the sub-coil element 12*a* (12*b*) can be easily wound by holding the spacing between the turns of the main coil element 11*a* (11*b*) of the main coil 11G in a widened state. In some cases, the spacing between the turns of the main coil element is held in a naturally widened state due to the spring-back action. With another method, the wire constituting the main coil 11G and the wire constituting the sub-coil 12G are wound at the same time. When the number of turns of the sub-coil is smaller than that of the main coil, that method includes a step of forming only the main coil. In the example illustrated in FIG. 10(I), for instance, an assembly including the sub-coil only in a part of the main coil is obtained by starting to form both the main coil and the sub-coil at the same time, and by forming only the main coil from an intermediate point in time.

Besides, as in the reactor 1A of Embodiment 1, the reactor 1G can also be constructed in the form where an insulator is disposed between the magnetic core 10G and the assembly of the main coil 11G and the sub-coil 12G, or the form where an assembled unit of the magnetic core 10G, the main coil 11G, and the sub-coil 12G are contained in a case, or the form where an outer resin portion is disposed at the surroundings of the assembled unit.

[Assembly of Reactor]

The reactor 1G having the above-described construction can be formed as follows. The inner core portion 10*c* is formed in a similar manner to that in Embodiment 1, and the sleeve-like portion of the insulator is arranged around the inner core portion 10*c*. The assembly of the main coil 11G and the sub-coil 12G, which has been separately fabricated as described above, is arranged over the inner core portion 10*c* including the sleeve-like portion. Further, the reactor 1G containing the assembled unit, which includes the annular magnetic core 10G and the assembly of the main coil 11G and the sub-coil 12G, is obtained by combining the inner core portion 10*c* and the outer core portions 10Ge with each other in a similar manner to that in Embodiment 1. The folded-back portion of the main coil 11G is placed on the support of one frame-like portion of the insulator. When constructing the form including the case or the form including the outer resin portion, that form is obtained by containing the above-mentioned assembled unit in the case and filling a potting resin into the case, or by coating the above-mentioned assembled unit with the outer resin portion.

Test Example 3

The leakage inductance in the interposed form described above was determined by simulation.

In this test, the number of turns of each sub-coil element was set to 10, and the number of turns of each main coil element was set to 60. The first 10 of the 60 turns of each main coil element and the turns of the sub-coil were alternately arranged one by one. With such an arrangement, a spacing corresponding to the thickness of one wire constituting the main coil element was given between adjacent twos of all the turns constituting the sub-coil. The leakage inductance was then determined when a current of 1 A was supplied to only the main coil in a state where the pair of sub-coil elements of the sub-coil were short-circuited. The results are indicated in Table III. Table III further indicates the results obtained with the sample No. 1-2 in Test Example 1 and with the reactor in the longitudinally end-to-end arranged form used in Test Example 1 together. The sizes of the magnetic cores used in Test Example 1 described above and this Test Example 3 were substantially the same.

TABLE III

| Sample No. | Form of reactor | Leakage inductance (μH) |
|---|---|---|
| 11-1 | Interposed form | 1.2 |
| Comparative | Longitudinally end-to-end arranged form | 5 |
| 1-2 | Layered form | 1.6 |

As seen from Table III, the reactor in the interposed form where the turn constituting the main coil is interposed between the turns constituting the sub-coil has a smaller leakage inductance than the reactor in the longitudinally end-to-end arranged form. It is also seen that the reactor in the interposed form has a smaller leakage inductance than the reactor in the layered form described in Embodiment 1.

[Advantageous Effects]

As in the reactor 1A in the layered form described in Embodiment 1, the reactor 1G in the interposed form, constructed as described above, can perform not only the step-up and step-down operations with the main coil 11G and the magnetic core 10G, but also the soft switching with the sub-coil 12G and the magnetic core 10G while reducing a loss. Further, because of including the magnetic core 10G in common to both the coils 11G and 12G, the reactor 1G has a small size. Moreover, the reactor 1G also has a portion where the spacing between the turns of the sub-coil 12G is wider than the spacing between the turns of the main coil 11G. In a portion of the main coil element 11*a* (11*b*) where the sub-coil 12G is not arranged (hereinafter referred to as a "singly arranged portion"), there is substantially no spacing between the adjacent turns. Accordingly, the spacing between the turns of the sub-coil 12G is wider than the spacing between the turns of the main coil element 11*a* (11*b*) in the singly arranged portion. As in Embodiment 1, therefore, the reactor 1G can reduce the leakage inductance in comparison with the reactor in the above-described longitudinally end-to-end arranged form. In the example illustrated in FIG. 10(I), particularly, the leakage inductance can be reduced with the arrangement that the sub-coil 12G is arranged closer to one end side (left side in FIG. 10) of the main coil 11G and the center positions of both the coils 11G and 12G in the axial direction are shifted from each other. Thus, as seen from Test Example 3, the reactor 1G can provide the leakage inductance comparable to or smaller than that in Embodiment 1.

In the reactor 1G in the interposed form, particularly, since the turns of the main coil 11G and the turns of the sub-coil 12G are alternately arranged, the spacing between the turns of the sub-coil 12G and the position of the sub-coil 12G relative to the main coil 11G can be easily maintained. Hence, the reactor 1G can more easily maintain the desired leakage inductance.

Further, in the reactor 1Q since the main coil 11G is constituted by the coated rectangular wire, the space factor can be increased and the length of each inner core portion 10*c* in the coil axial direction can be shortened, thus resulting in a smaller size. Moreover, in the reactor 1G, since the sub-coil 12G is constituted by the coated electric wire, the electrical insulation between both the coils 11G and 12G can be ensured even when both the coils 11G and 12G are arranged in contact with each other. In the reactor 1G, therefore, it is not required to interpose an additional insulating member between both the coils 11G and 12G. This also contributes to reducing the reactor size. Moreover, since the sub-coil 12G does not include the folded-back portion, the reactor 1G is substantially not required to have a region in the magnetic core 10G where a joining portion for interconnecting both the sub-coil elements 12*a* and 12*b* is to be arranged. This further contributes to reducing the reactor size. Additionally, in the reactor 1G, since the wire forming each turn of the main coil element 11*a* (11*b*) and the wire forming each turn of the sub-coil element 12*a* (12*b*) are alternately arranged one by one, the wire of the sub-coil does not project outward of the main coil in comparison with the case where parts of the turns of the sub-coil are arranged around the main coil in crossing relation to the turns of the main coil. This still further contributes to reducing the reactor size. In the reactor 1G in the interposed form including the above-described assembly of the main coil 11G and the sub-coil 12Q the width (i.e., the size in a direction (vertical direction in FIG. 10) perpendicular to the coil axial direction) of each outer core portions 10Ge of the magnetic core 10G can be reduced, for example, in comparison with that of each outer core portion 10*e* of the magnetic core 10A of the reactor 1A in the layered form. Therefore, the size of the reactor 1G is further reduced. Thus, the reactor in the interposed form has a small size and a small leakage inductance. In addition, the reactor 1G also has a superior heat dissipation effect because the main coil 11G and the sub-coil 12G are arranged only over the inner core portion 10*c* while the outer core portions 10Ge are exposed.

The reactor in the interposed form may be modified, like a reactor 1H illustrated in FIG. 10(II), such that plural (here, three) turns of each main coil element 11*a* (11*b*) constituting a main coil 11H are interposed between turns of each sub-coil element 12*a* (12*b*) constituting a sub-coil 12H.

The spacing between the turns of the sub-coil element 12*a* (12*b*) of the sub-coil 12H in the reactor 1H is wider than that between the turns of the sub-coil element 12*a* (12*b*) of the sub-coil 12G in the reactor 1G illustrated in FIG. 10(I). More specifically, the spacing in the sub-coil 12H is widened from that in the sub-coil 12G by a size corresponding to two turns of the wire constituting the main coil 11H. Thus, in the reactor 1H, since the spacing between the turns in the sub-coil 12H is widened from that in the sub-coil 12G, the leakage inductance can be further reduced as seen from Test Example 1 described above.

A part of the wire forming each turn of the sub-coil element 12*a* (12*b*) of the sub-coil 12H is arranged around the turns of the main coil element 11*a* (11*b*) in crossing relation to the turns of the main coil element 11*a* (11*b*). In other words, some of the turns constituting the sub-coil 12H are arranged around the main coil 11H in overlapped relation. Here, parts of the wire constituting the sub-coil 12H, which parts are arranged in crossing relation to an outer peripheral surface of the main coil element 11*a* (11*b*), are all positioned in regions of the outer peripheral surface of the main coil element 11*a* (11*b*), those regions being located on the same side. With such an arrangement, the width (i.e., the size in the direction (vertical direction in FIG. 10) perpendicular to the coil axial direction) of the reactor or the height (i.e., the size in a direction toward the front of a drawing sheet from the back in FIG. 10) of the reactor can be reduced by an amount corresponding to the thickness of the wire constituting the sub-coil in comparison with that when the crossing parts of the sub-coil are arranged at random in regions of the outer peripheral surface of the main coil, those regions being located on different sides.

The reactor 1H illustrated in FIG. 10(II) has the form where, although the number of turns of the sub-coil element 12*a* (12*b*) is smaller than that of the main coil element 11*a* (11*b*), the spacing between the turns of the sub-coil element 12*a* (12*b*) is widened such that the sub-coil element 12*a* (12*b*) exists substantially over the entire length of the main coil element 11*a* (11*b*). In an alternative form, the sub-coil may be present only in a portion of the main coil as in the reactor 1G illustrated in FIG. 10(I). Further, while the reactor 1H illustrated in FIG. 10(II) has been described in connection with the case where the number of turns of the main coil 11H present between the turns of the sub-coil 12H is even, different numbers of turns of the main coil may be present between the turns of the sub-coil. For example, the reactor may include a portion in which plural turns constituting the sub-coil are sandwiched together between the turns constituting the main coil.

In the above-described reactors 1G and 1H, the wires constituting the main coil and the sub-coil may be of the same type, or they may be the coated round wires other than the coated rectangular wire and the coated electric wire described above. When the wires of the main coil and the sub-coil are the coated rectangular wires, the following advantageous effects are obtained by employing, as the coated rectangular wire constituting the sub-coil, the wire having the same width as the coated rectangular wire constituting the main coil and being thinner than it (e.g., a half of the thickness of the wire constituting the main coil): (1) the axial length of the sub-coil can be easily shortened, whereby the size of the reactor can be reduced, (2) when respective one end portions of the wires of both the coils are joined to each other by, e.g., welding, a contact area between both the wires can be sufficiently ensured, and (3) because both the coils have the same contour shape and, in the assembly of both the coils, coil surfaces positioned on the installation side when the reactor is installed are flush with each other, the heat dissipation effect can be increased by setting the assembly of both the coils being to be held in contact with a cooling base.

In a reactor in the toroidal form, when a magnetic core is formed such that an outer peripheral surface of a portion (outer core portion in the above-described examples) of the magnetic core where both the coils are not arranged and an outer peripheral surface of the assembly of the main coil and the sub-coil are flush with each other, the following advantageous effects can be obtained; (1) reduction of the installation surface, (2) improvement of the heat dissipation effect, and (3) stabilization of the installed state. For example, the magnetic core may have such a form that a part of an outer peripheral surface of the outer core portion, which part is positioned on the installation side when the reactor is installed, is projected more outwardly than a part of an outer peripheral surface of the inner core portion, which part is positioned on the installation side. In that case, because the length of the magnetic core in the coil axial direction can be shortened corresponding to an increase in the height of the magnetic core, the installation area can be reduced. Further, in the reactor including the magnetic core in that projected form, because not only the coils, but also the magnetic core can be fixed in contact with the cooling base, it is possible to stabilize the fixed state of the reactor and to improve the heat dissipation effect. The magnetic core having that projected form can be easily formed as a power compact.

Embodiment 11 and 12

A reactor 1I of Embodiment 11 and a reactor 1J of Embodiment 12 will be described below with reference to FIG. 11. Embodiment 11 represents a reactor constructed in the E-E form and the layered form, and Embodiment 12 represents a reactor constructed in the E-E form and the interposed form.

As in the reactors in the toroidal form described in Embodiments 1 to 10, the reactor 1I of Embodiment 11 includes a magnetic core 10P, a main coil 11I, and a sub-coil 12I, these coils being arranged over a part (inner core portion 10*i*) of the magnetic core 10P. The reactor 1I differs from of the reactors in the toroidal form, described in Embodiments 1 to 10, in the form of the magnetic core and the number of coils (coil elements). The following description is made primarily about the different points, and detailed description of construction like that in Embodiments 1 to 10 is omitted. The reactor 1J of Embodiment 12 is substantially the same as the reactor 1I of Embodiment 11 except for the layout of the main coil and the sub-coil. Accordingly, with regard to the reactor 1J, the following description is made primarily about the layout of both the coils, and description of the remaining construction is omitted.

[Coils]

The reactor 1I, 1J includes one main coil 11I, 11J and one sub-coil 12I, 12J, respectively, without including a pair of coil elements for each of the main coil and the sub-coil. The main coils 11I and 11J are each an edgewise coil that is formed by spirally winding a continuous wire (here, a coated rectangular wire). The sub-coils 12I and 12J are each formed by spirally winding a continuous wire (here, a coated electric wire) which differs from the wires constituting the main coils 11I and 11J.

While a coated electric wire having a smaller conductor cross-sectional area than each of the coated rectangular wires constituting the main coils 11I and 11J is used here as each of the coated electric wires constituting the sub-coils 12I and 12J, the coated electric wire used here may have a conductor cross-sectional area comparable to that of the coated rectangular wire. Further, the number of turns of each of the sub-coils 12I and 12J is smaller than that of each of the main coils 11I and 11J.

<Layered Form>

The reactor 1I has the layered form where the sub-coil 12I is concentrically arranged around the main coil 11I. Further, in the reactor 1I, the spacing between adjacent turns constituting the main coil 11I is narrow, i.e., 0.5 mm or less, and the spacing between adjacent turns constituting the sub-coil 12I is wider than that in the main coil 11I. In the reactor 1I, the spacing between the adjacent turns constituting the sub-coil 12I is widened to such an extent that the axial length of the sub-coil 12I is substantially equal to that of the main coil 11I. Moreover, the spacing between the adjacent turns is even for all of the adjacent turns constituting the sub-coil 12I.

<Interposed Form>

Figure 11:
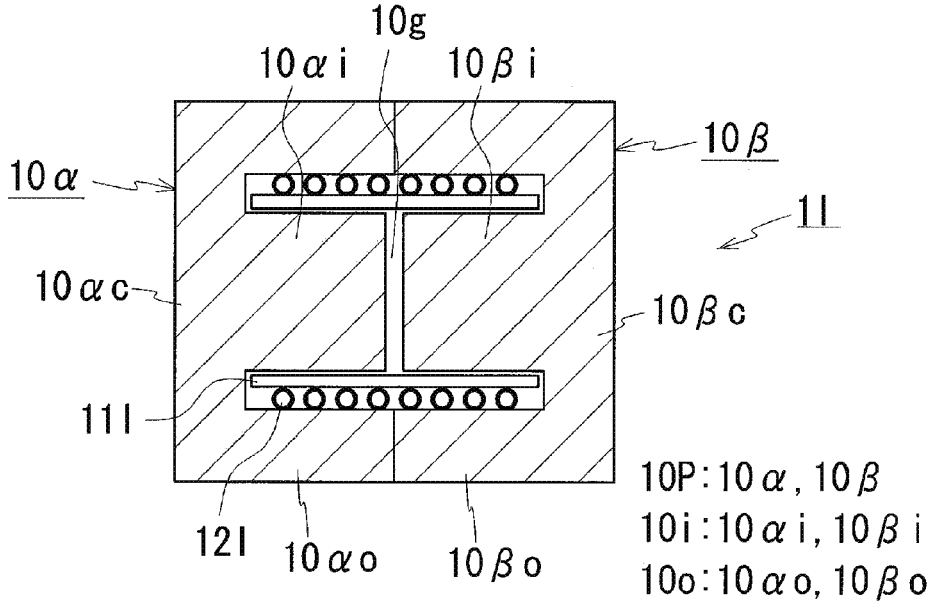
FIG. 11 is a schematic sectional view to explain the layout of an E-E type magnetic core and coils, both constituting a reactor of Embodiment 11; specifically.
Figure 11:
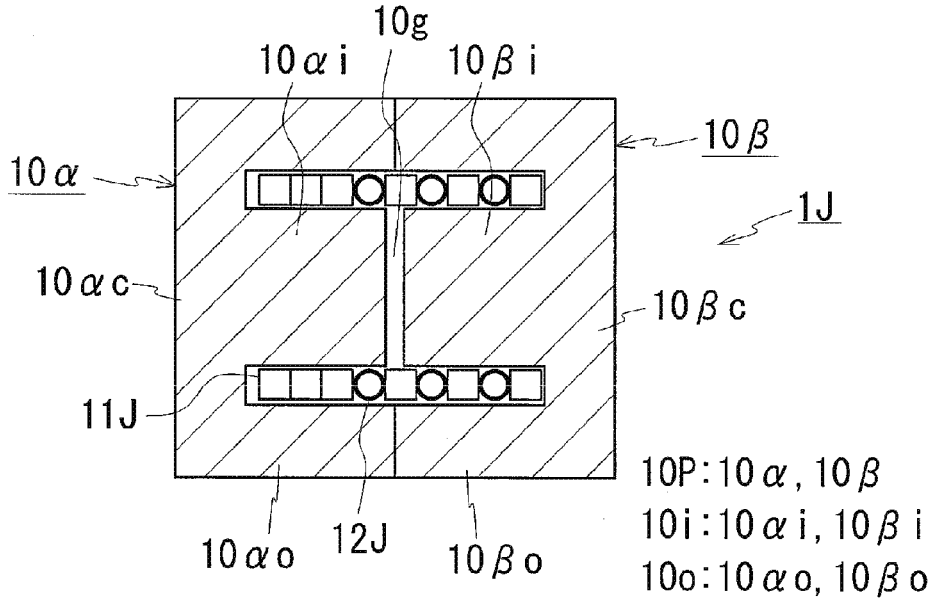

On the other hand, the reactor 1J illustrated in FIG. 11(II) has the interposed form where the wire forming each turn of the main coil 11J and the wire forming each turn of the sub-coil 12J are alternately arranged one by one such that the turns of the sub-coil 12J are each interposed between the turns of the main coil 11J. Thus, both the coils 11J and 12J of the reactor 1J are arranged around the inner core portion 10*i* in a state where the axes of both the coils lie on a linear line as in the reactor 1G of Embodiment 10. Further, in the reactor 1J, since the turns of both the coils 11J and 12J are alternately arranged one by one as described above, the spacing between the adjacent turns is even for all of the adjacent turns constituting the sub-coil 12J as in the reactor 1G illustrated in FIG. 10(I). Here, since the number of turns of the sub-coil 12J is smaller than that of the main coil 11J, the sub-coil 12J is present only in a part of the main coil 11J. Moreover, as in the reactor 1G of Embodiment 10, the sub-coil 12J is arranged here closer to the one end side of the main coil 11J such that center positions of both the coils 11J and 12J are shifted from each other. In an alternative form, the sub-coil 12J may be assembled to the main coil 11J such that their center positions are aligned with each other.

In the reactors 1I and 1J, the types, the thicknesses and widths, the conductor cross-sectional areas, the numbers of turns, etc. of the wires constituting the main coil and the sub-coil can be selected as appropriate. In the reactor in the layered form, as described above, electrical insulation between the main coil and the sub-coil can be enhanced by employing the coated electric wire as the wire of one of the coils and employing the coated rectangular wire or the coated round wire as the other coil, or by employing the coated electric wires as the wires of both the coils. Further, as described above in Test Example 1, the leakage inductance is changed depending on the distance of the spacing between the adjacent turns of each of the sub-coils 12I and 12J in the reactors 1I and 1J. Moreover, as described above in Test Example 2, the leakage inductance is also changed depending on the shift amount between the center positions of the main coil and the sub-coil. Accordingly, the spacing between the adjacent turns of the sub-coil and the position of the sub-coil relative to the main coil can be appropriately selected so that the desired leakage inductance is obtained. In addition, as described in Embodiment 10, the spacing between the adjacent turns may be uneven for all of the adjacent turns of the sub-coil.

In the reactors 1I and 1J, too, terminal members are connected to both end portions (not illustrated) of the wire constituting each of the main coils 11I and 11J and to both end portions (not illustrated) of the wire constituting each of the sub-coil 12I and 12J. Further, for example, one of the terminal members of the main coil 11I, 11J and one of the terminal members of the sub-coil 12I, 12J are connected to each other using, e.g., a bolt. Alternatively, one end portion of the main coil 11I, 11J and one end portion of the sub-coil 12I, 12J are directly joined to each other, and one terminal member is attached to the joined portions.

[Magnetic Core]

In this embodiment, the magnetic cores 10P of the reactors 1I and 1J are E-E type cores partly covering respective surroundings of the assembly of the main coil 11I and the sub-coil 12I and the assembly of the main coil 11J and the sub-coil 12J. A closed magnetic path is formed by combining a pair of core pieces 10α and 10β, each having an E-shaped section, with each other. The magnetic core 10P includes a columnar inner core portion 10*i* that is arranged inside the main coil 11I (inside the main coil 11J and the sub-coil 12J in the case of the reactor 1J), an outer core portion 10*o* arranged outside the assembly of the main coil 11I (11J) and the sub-coil 12I (12J), and a connecting core portion arranged at each of both end surfaces of the above-mentioned assembly. The core pieces 10α and 10β include respectively inner core pieces 10αi and 10βi constituting the inner core portion 10*i*, outer core pieces

10αo and 10β0 constituting the outer core portion 10*o*, and connecting core pieces 10αc and 10βc constituting the connecting core portion.

Between the inner core piece 10αi, 10βi and the outer core piece 10αo, 10βo, a space is formed in such a size as allowing the assembly of the main coil 11I and the sub-coil 12I (or the assembly of the main coil 11J and the sub-coil 12J) to be contained in the space. In the illustrated form, the outer core pieces 10αo and 10βo are a pair of members arranged opposite to each other such that, as mentioned above, a part of the surroundings of the assembly of both the coils is covered with the magnetic core 10P while the other part is exposed from the magnetic core 10P. However, the magnetic core 10P may be formed as the so-called pot type core in which the outer core pieces are formed as a sleeve-like member and substantially the entire surroundings of the assembly of both the coils are covered with the sleeve-like member.

The core pieces 10α and 10β may be each an integral unit obtained by integrally forming the inner core piece, the outer core piece, and the connecting core piece, or a joined unit obtained by joining those pieces together with an adhesive, for example. The core pieces 10α and 10β can be each formed using a powder compact or a stack obtained by stacking a plurality of electrical steel sheets. Further, partition lines of core pieces constituting the magnetic core 10P can be selected as appropriate, and the magnetic core is not limited to the sectional E-E form described above. Other exemplary forms include (1) a form including one columnar inner core portion, one sleeve-like outer core portion (or a pair of plate-like outer core portions arranged opposite to each other), and a pair of plate-like connecting core portions, (2) a form, i.e., a [-I-] form, including one columnar inner core portion, and a pair of core pieces each of which has a]-like section and is obtained by combining a short sleeve-like outer core piece (or a pair of short plate-like outer core pieces arranged opposite to each other) and one plate-like connecting core portion with each other, (3) a form, i.e., an E-[ form, including a core piece which has an E-like section and is obtained by combining one columnar inner core portion, a short sleeve-like outer core piece (or a pair of short plate-like outer core pieces arranged opposite to each other), and one plate-like connecting core portion with each other, and a core piece which has a]-like section and is obtained by combining a short sleeve-like outer core piece (or a pair of short plate-like outer core pieces arranged opposite to each other) and one plate-like connecting core portion with each other, (4) a form, i.e., an E-I form, including a core piece which has an E-like section and is obtained by combining one columnar inner core portion and one sleeve-like outer core portion (or a pair of plate-like outer core pieces arranged opposite to each other) and one plate-like connecting core portion with each other, and one plate-like connecting core portion, and (5) a form, i.e., a T-] form, including a core piece which has a T-like section and is obtained by combining one columnar inner core portion and one plate-like connecting core piece with each other, and a core piece which has a]-like section and is obtained by combining one sleeve-like outer core portion (or a pair of plate-like outer core portions arranged opposite to each other) and one plate-like connecting core portion with each other. In any of the above-described forms, a predetermined gap can be formed between the inner core portion and the connecting core portion by adjusting the length of the inner core portion as appropriate, and the gap can be utilized as an air gap.

The integral magnetic core 10P can be formed by arranging the inner core piece 10αi and the outer core piece 10αo of the one core piece 10α and the inner core piece 10βi and the outer core piece 10βo of the other core piece 10β opposite to each other, and by joining the outer core pieces 10αo and 10βo to each other with an adhesive, for example. In this embodiment, sizes of the inner core pieces 10αi and 10βi and the outer core pieces 10αo and 10βo are adjusted such that a predetermined gap 10*g* is formed between the inner core pieces 10αi and 10βi in the state where the outer core pieces 10αo and 10βo are joined to each other (i.e., such that the main coil and the sub-coil provide the desired inductance). Thus, the inner core portion 10*i* is constituted by a pair of the inner core pieces 10αi and 10βi and the gap 10*g*. The gap 10*g* in the inner core portion 10*i* is formed for adjustment of the inductance. Here, the gap 10*g* is utilized as an air gap.

In an alternative form, a gap member made of a non-magnetic material, e.g., alumina, may be interposed between the inner core pieces instead of forming the air gap. In that case, the gap member is preferably joined to the inner core pieces 10αi and 10βi using an adhesive. The position where the air gap or the gap member is to be provided, and the number of air gaps or gap members to be provided can be selected as appropriate such that the main coil and the sub-coil provide the desired inductance. For example, plural air gaps or gap members are provided in the inner core portion, or the air gap or the gap member is provided in the outer core portion instead of the inner core portion, or the air gaps or the gap members are provided in both of the inner core portion and the outer core portion.

Besides, as in the reactor 1A of Embodiment 1, the reactors 1I and 1J can also be each constructed in the form where an insulator is disposed between the magnetic core 10P (inner core portion 10*i*) and the main coil 11I (the main coil 11J and the sub-coil 12J in the case of the reactor 1J), or the form where an assembled unit of the magnetic core 10P, the main coil, and the sub-coil are contained in a case, or the form where an outer resin portion is disposed at the surroundings of the assembled unit. Insulation between end surfaces of the assembly of the main coil and the sub-coil and the connecting core portions can be enhanced by employing such an insulator that includes a sleeve-like member covering an outer periphery of the inner core portion 10*i* and annular flanges extending outwardly from both edges of the sleeve-like member.

[Assembly of Reactor]

The above-described reactor 1I in the layered form can be formed as follows. First, an assembly including the main coil 11I and the sub-coil 12I, which are concentrically arranged in that order around the insulator (sleeve-like member), is formed. More specifically, the main coil 11I is formed with the insulator used as a winding drum. Thereafter, the sub-coil 12I is formed at a predetermined position on the outer periphery of the main coil 11I, or the sub-coil 12I separately fabricated is assembled to the predetermined position. The position of the sub-coil 12I relative to the main coil 11I can be selected as appropriate, and the center positions of both the coils 11I and 12I in the axial direction may be aligned with or shifted from each other.

Next, the inner core piece 10αi of the one core piece 10α is inserted into one opening of the insulator including the assembly of both the coils 11I and 121, and the inner core piece 10βi of the other core piece 10β is inserted into the other opening of the insulator. The outer core pieces 10αo and 10βo of both the core pieces 10α and 10β are joined to each other using an adhesive, for example. With the joining, the predetermined gap 10*g* is formed between the inner core pieces 10αi and 10βi. The reactor 1I is obtained through the above-described steps.

On the other hand, when the reactor 1J in the interposed form is fabricated, the assembly of the main coil 11J and the sub-coil 12J can be easily assembled to the magnetic core 10P, as in the layered form described above, by fabricating the assembly of the main coil 11J and the sub-coil 12J in advance. That assembly is obtained, for example, by forming the main coil 11J around the insulator as described above, and then winding the wire of the sub-coil 12J between the turns of the main coil 11J as described in Embodiment 10. On that occasion, the formation of the sub-coil 12J is facilitated, as described in Embodiment 10, by holding the spacing between the turns of the main coil 11J in the widened state. Alternatively, as described in Embodiment 10, the wires constituting both the coils 11J and 12J may be wound simultaneously. The magnetic core 10P is assembled, as in the foregoing layered form, by inserting the inner core pieces 10αi and 10βi of the core pieces 10α and 10β into the insulator including the assembly of both the coils 11J and 12J as described above. Thus, the reactor 1J is obtained.

When forming the reactor 1I, the operation of assembling the main coil 11I and the sub-coil 12I is facilitated, as described in Embodiment 1, by extending the end portion of at least one of the wire of the main coil 11I in the axial direction of the main coil 11I. After the assembly operation, it is advantageous, as described above, that the extended end portion of the wire of the main coil 11I is bent, for example, as appropriate. Alternatively, as described in Embodiment 1, the sub-coil 12I may be slightly deformed and, after assembling it to the main coil 11I, the sub-coil 12I may be reshaped. Additionally, the insulator may be arranged after assembling the latter sub-coil 12I around the main coil 11I, thereby fabricating the assembly of the main coil 11I and the sub-coil 12I. In that case, the insulator can be easily arranged into the assembly by employing an insulator of the type forming a sleeve-like shape when a pair of halved split pieces are combined with each other. When forming the reactor 1J, the insulator may be likewise inserted into the assembly of the main coil and the sub-coil after the assembly has been fabricated. Alternatively, the reactors 1I and 1J may be each formed by fabricating the assembly of the main coil and the sub-coil in advance, and covering the surroundings of the assembly with resin, thus forming a coil molded product in which the assembly is held in the assembled state with the resin. With the use of the coil molded product, the main coil and the sub-coil can be easily handled when they are assembled to the magnetic core, and the above-mentioned insulator can be dispensed with. For example, an epoxy resin can be used as the resin of the coil molded product.

The joining between respective one end portions of the main coil 11I and the sub-coil 12I and the joining between respective one end portions of the main coil 11J and the sub-coil 12J can be performed at desired timing. Because the magnetic core 10P of this embodiment includes portions where the coils are exposed, as described above, the joining may be performed at any timing before assembling the main coil and the sub-coil to the magnetic core 10P, or after assembling the assembled unit of the magnetic core 10P, the main coil, and the sub-coil. In the pot type core, respective end portions of both the coils are joined to each other before the assembly of both the coils is covered with the outer core portions.

The obtained assembled unit, which includes the magnetic core 10P and the assembly of both the coils, may be contained in a case that is then filled with a potting resin, or it may be covered with the outer resin portion.

[Advantageous Effects]

As in the reactors 1A to 1H in the toroidal form described in Embodiments 1 to 10, the reactors 1I and 1J in the E-E form, constructed as described above, can perform not only the step-up and step-down operations with the main coils 11I and 11J and the magnetic core 10P, but also the soft switching with the sub-coils 12I and 12J and the magnetic core 10P while reducing a loss. Further, because of including the magnetic core 10P in common to both the coils 111 and 12I or both the coils 11J and 12J, the reactor 1I, 1J has a small size. The reactors 1I and 1J thus constructed can be preferably applied to the case where the number of turns of each of the main coil and the sub-coil is small and the gap 10*g* formed in the magnetic core 10P can be set small, e.g., the case where the frequency of a current in use is high and an inductance value is small.

Particularly, in the reactor 1I in the layered form, since the axial length of the sub-coil 12I is not longer than that of the main coil 11I, there is substantially no need of changing the length of the inner core portion 10*i* (i.e., the length of the main coil 11I in the axial direction (right-and-left direction in FIG. 11)) (stated another way, there is substantially no increase in the axial length) regardless of the sub-coil 12I being added to the main coil 11I. Therefore, the reactor 1I has a small size. On the other hand, in the reactor 1J in the interposed form, the width and the height of the reactor (the width and the height representing dimensions in directions perpendicular to the axial direction of the main coil 11J) can be reduced in comparison with those of the reactor in the layered form. Therefore, the reactor 1J has a smaller size. Further, in each of the reactors 1I and 1J, since the main coil is formed of the coated rectangular wire, the space factor can be increased and the size of the main coil can be reduced. This also contributes to shortening the length of the inner core portion 10*i* and to reducing the reactor size.

In each of the reactors 1I and 1J in the E-E form, since the assembly of the main coil and the sub-coil is arranged over only the inner core portion 10*i* and there is just one inner core portion 10*i*, the assembled unit including the magnetic core 10P and the assembly of both the coils can be easily formed. This ensures higher productivity of the reactor. Further, the main coil and the sub-coil are not arranged over the outer core portion 10*o* and the connecting core portion, the reactors 1I and 1J also have the superior heat dissipation effect.

Moreover, in each of the reactors 1I and 1J, the gap 10*g* for adjusting the inductance is provided at just one position, and the gap 10*g* is utilized as an air gap without using any gap member. It is hence possible to reduce the number of components and to cut the step of attaching the gap member. From that point as well, the reactors 1I and 1J have higher productivity.

In the E-E form, the wires constituting the main coil and the sub-coil may also be each the coated round wire other than the coated electric wire or the coated rectangular wire. Further, in the E-E form, the wires constituting the main coil and the sub-coil may be the same type of wire as in Embodiments 1 to 10. The wire constituting the sub-coil may be a wire having a conductor made of aluminum or an aluminum alloy. In addition, the sub-coil of the reactor 1I in the layered form may be an edgewise coil or a flatwise coil using the coated rectangular wire, or may be a coil formed using a sheet-like wire.

Reference Example 1

Figure 12:
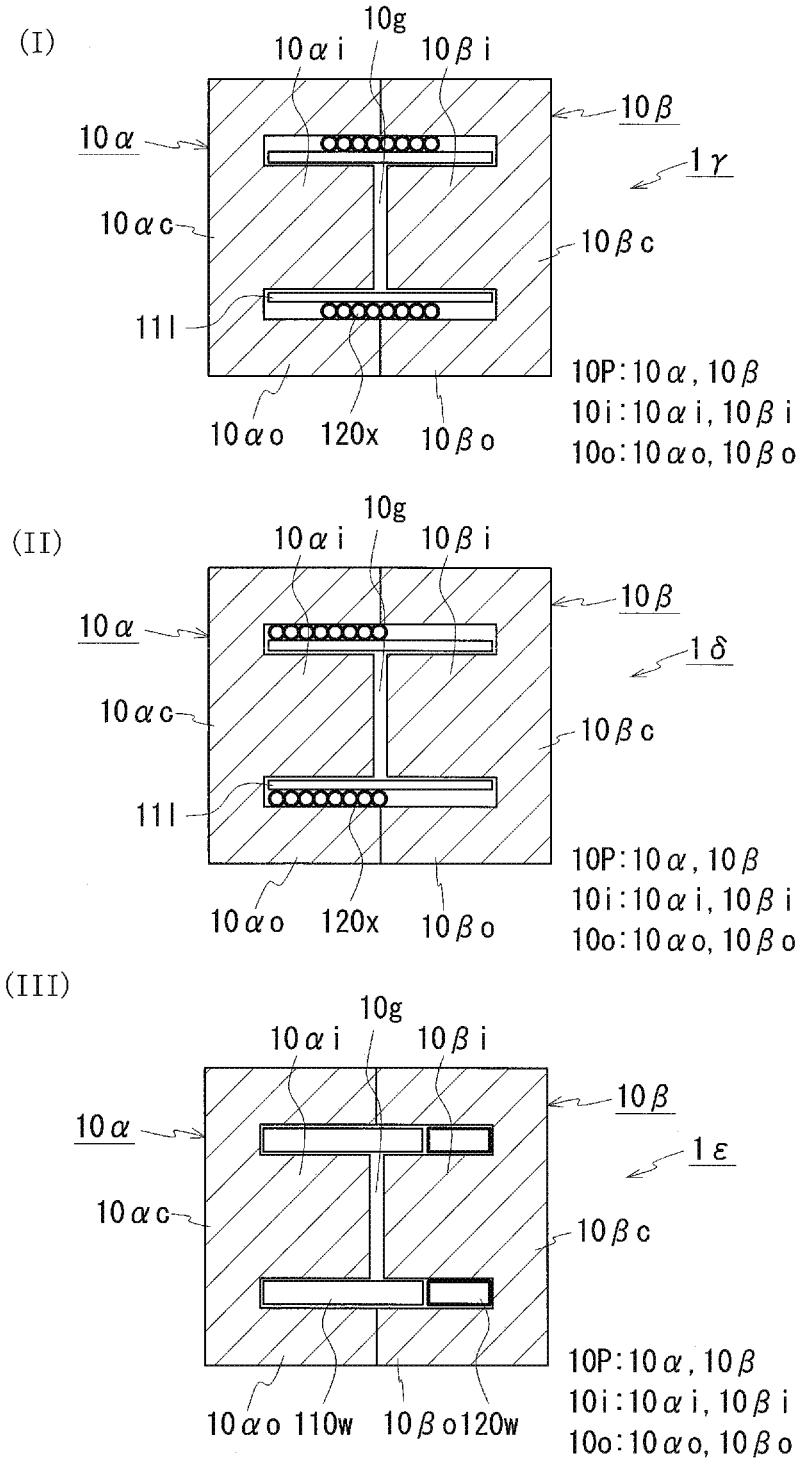
FIG. 12 is a schematic sectional view to explain the layout of an E-E type magnetic core and coils, both constituting a reactor of Reference Example 1; specifically.

FIG. 12 illustrates other forms of the reactor including the E-E type magnetic core 10P and the assembly of the main coil and the sub-coil. The following description is made just about the layout of the main coil and the sub-coil, and detailed description of the construction in common to the reactors 1I and 1J is omitted.

<Reactor 1γ>

A reactor 1γ illustrated in FIG. 12(I) has the layered form where a sub-coil 120*x* is concentrically arranged around a main coil 11I, and the spacing between adjacent turns constituting the sub-coil 120*x* is equal to the spacing between adjacent turns constituting the main coil M. Further, in the reactor 1γ, both the coils 11I and 120*x* are layered such that a center position of the main coil 11I in the axial direction and a center position of the sub-coil 120*x* in the axial direction are the same. In the illustrated example, because the number of turns of the sub-coil 120*x* is smaller than that of the main coil 11I, respective end surfaces of both the coils 11I and 120*x* are not aligned with each other and are shifted in the axial direction of the main coil M. In each of the reactor 1γ, a reactor 13 described later, and the above-described reactor of Embodiment 11, the size in the coil axial direction can be reduced in comparison with a later-described reactor 1ϵ is in the longitudinally end-to-end arranged form.

<Reactor 1δ>

As in the reactor 1γ, a reactor 13 illustrated in FIG. 12(II) also has the layered form, and the spacings between the turns of both the coils 11I and 120*x* are equal to each other. In the reactor 1δ, however, both the coils 11I and 120*x* are layered such that the center position of the main coil 11I in the axial direction is different from the center position of the sub-coil 120*x* in the axial direction. In the illustrated example, both the coils 11I and 120*x* are arranged such that only respective one end surfaces of both the coils 11I and 120*x* are aligned with each other. In the reactor 16, since the center positions of both the coils 11I and 120*x* are shifted from each other as mentioned above, the leakage inductance can be reduced.

<Reactor 1ϵ>

The reactor 1ϵ is illustrated in FIG. 12(III) has the longitudinally end-to-end arranged form where a main coil 110*w* and a sub-coil 120*w* are coaxially arranged adjacent to each other in the axial direction of the main coil 110*w*. The reactor is in the longitudinally end-to-end arranged form has higher productivity because an assembly of the main coil 110*w* and the sub-coil 120*w* can be easily formed. As in the reactor 1I of Embodiment 11, etc., the reactor 1ϵ is in the longitudinally end-to-end arranged form can also be obtained by arranging both the coils 110*w* and 120*w* around the insulator, and by inserting the inner core pieces 10αi and 10βi of the core pieces 10α and 10β into the insulator, thus assembling the magnetic core 10P.

Test Example 4

The leakage inductance of the reactor in the E-E form was determined by simulation.

In this test, the reactor 1γ (layered form) illustrated in FIG. 12(I), the reactor 1J (interposed form) illustrated in FIG. 11(II), and the reactor is (longitudinally end-to-end arranged form) illustrated in FIG. 12(III) were prepared, and the leakage inductance was determined for each reactor. The reactors in those forms were each fabricated on the following conditions, i.e., the main coil: coated rectangular wire, the sub-coil: coated electric wire, the main coil: 60 turns, and the sub-coil: 10 turns. In the reactor 1J in the interposed form, the first 10 of the 60 turns of the main coil and the turns of the sub-coil were alternately arranged one by one. In the reactor 1ϵ in the longitudinally end-to-end arranged form, both the coils were arranged in longitudinally end-to-end relation with the coupling coefficient of 0.9. Further, the magnetic cores having substantially the same size were used in this test.

The leakage inductance was determined when a current of 1 A was supplied to only the main coil in a state where the sub-coil was short-circuited. The results are indicated in Table IV.

TABLE IV

| Sample No. | Form of reactor | Leakage inductance (μH) |
|---|---|---|
| Comparative | Layered form | 1.4 μH |
| 12-1 | Interposed form | 1.0 μH |
| Comparative | Longitudinally end-to-end arranged form | 4.5 μH |

As seen from Table IV, the value of the leakage inductance can also be changed in the E-E form by changing, e.g., the layout of the main coil and the sub-coil. The form of the magnetic core, the layout of the main coil and the sub-coil, the spacing between the turns of each coil, the relative positional relation between both the coils, etc. are preferably selected and adjusted as appropriate so that the reactor having the desired leakage inductance is obtained.

Reference Example 2

Figure 13:
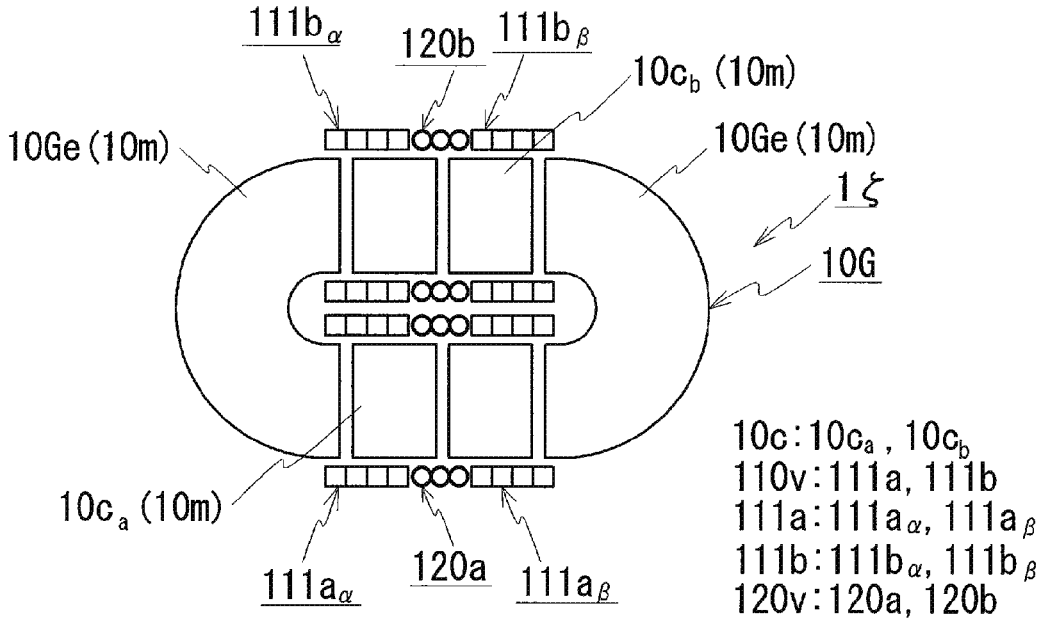
FIG. 13 is a schematic explanatory view to explain the layout of an annular magnetic core and coils, both constituting a reactor of Reference Example 2.
Figure 14:
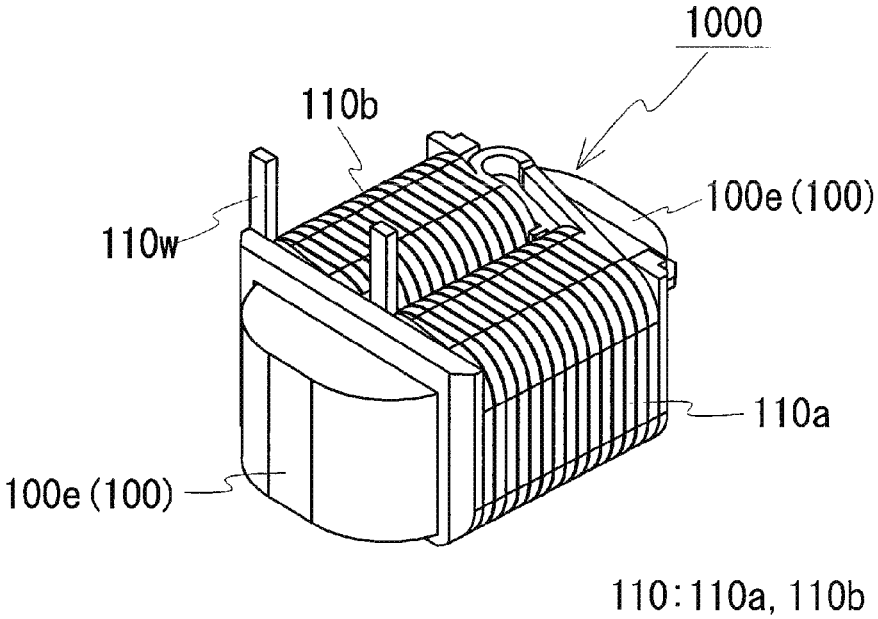
FIG. 14 is a perspective view illustrating one example of a related-art reactor.

Regarding the reactor in the interposed form including one magnetic core and the assembly of the main coil and the sub-coil, FIG. 13 illustrates another form where plural turns constituting the sub-coil are sandwiched together between the turns constituting the main coil.

A reactor 1ζ illustrated in FIG. 13 has the interposed form as in the reactors 1G and 1H of Embodiment 10, and main coil elements 111*a* and 111*b* of a main coil 110*v* are each split into two pieces. Further, all turns of one sub-coil element 120*a* of a sub-coil 120*v* are sandwiched together between split coils $111a_\alpha$ and $111a_\beta$ constituting one main coil element 111*a*, and all turns of the other sub-coil element 120*b* are sandwiched together between split coils $111b_\alpha$ and $111b_\beta$ constituting the other main coil element 111*b*.

In the illustrated example, one continuous coated electric wire is used as a wire of the sub-coil 120*v*, and both the sub-coil elements 120*a* and 120*b* are coupled to each other through a bridging portion (not illustrated) that is formed using a part of the wire. On the other hand, in the main coil 110*v*, the above-mentioned four split coils $111a_\alpha$, $111a_\beta$, $111b_\alpha$ and $111b_\beta$ are formed using four different wires (here, coated rectangular wires). Further, end portions of the wires of the split coils $111a_\alpha$ and $111a_\beta$ ($111b_\alpha$ and $111b_\beta$) constituting one main coil element 111*a* (111*b*) are arranged around the sub-coil 120*v* in straddling relation to the one sub-coil element 120*a* (120*b*) of the sub-coil 120*v*. Those end portions are joined to each other by welding, for example, whereby the split coils $111a_\alpha$ and $111a_\beta$ ($111b_\alpha$ and $111b_\beta$) are integrated with each other. Moreover, end portions of both the main coil elements 111*a* and 111*b* are also joined to each other by welding, for example. Thus, the turns constituting the main coil 110*v* here may include the form where those turns are formed by joining the wires as described above.

While the above-mentioned joining between the end portions of the wires may be performed by utilizing, e.g., a separate plate member for connection, the number of positions to be joined and the number of joining steps can be reduced by arranging the end portions of the wires as close as possible to each other, and by directly joining the end portions. Further, while the joining operation may be performed at desired timing, the sub-coil can be easily arranged, for example, by joining the split coils to each other after the sub-coil has been arranged between the split coils.

Moreover, the number of positions to be joined and the number of joining steps can be reduced by employing one continuous wire to form both the one split coil of the one main coil element and the one split coil of the other main coil element.

While the reactor 1ζ has the form where the sub-coil elements 120*a* and 120*b* are present respectively near centers of the main coil elements 111*a* and 111*b*, the leakage inductance tends to reduce by shifting the position of the sub-coil such that the sub-coil is present closer to one end portion of the main coil, as in the reactor 1G of Embodiment 10. Thus, the leakage inductance can be simply reduced, as described above, by adjusting the position where the sub-coil is arranged.

In the reactors 1Q, 1H and 1ζ in the interposed form, the leakage inductance differs depending on different coil layouts. Of those reactors 1Q, 1H and 1ζ, the leakage inductance tends to become minimum in the reactor 1ζ in which the plural turns of the sub-coil are arranged together, and it tends to increase in the reactor 1G in which the turns of the main coil and the turns of the sub-coil are alternately arranged one by one. Thus, the coil layout can be selected such that the desired leakage inductance is obtained.

It is to be noted that the foregoing embodiments can be modified as appropriate without departing from the gist of the present invention, and they are not limited to the above-described constructions. For example, the spacing between the adjacent turns of each of the main coil and the sub-coil, the number of turns of each coil, etc. can be changed as appropriate.

INDUSTRIAL APPLICABILITY

The reactor of the present invention can be suitably utilized as a component of a power conversion device, such as a two-way soft-switching DC-DC converter that is mounted on a vehicle, such as a hybrid car, an electric car, or a fuel cell car. Further, the method of adjusting the leakage inductance of the reactor, according to the present invention, can be preferably utilized in forming the reactor of the present invention.

REFERENCE SIGNS LIST

1A, 1B, 1C, 1D, 1E, 1F, 1G, 1H, 1I, 1J, 1*z*, 1α, 1β, 1γ, 1δ, 1ε, 1ζ reactors
10A, 10D, 10G, 10P magnetic cores
10*c*, 10$c_a$, 10$c_b$, 10*i* inner core portions
10*e*, 10De, 10Ge, 10*o* outer core portions
10*m* magnetic substance portion 10*g* gap
10α, 10β core pieces
10αi, 10βi inner core pieces 10αo, 10βo outer core pieces
10αc, 10βc connecting core pieces
11A, 11G 11H, 11I, 11J mail coils
11*a*, 11*b* main coil elements
11*w*, 12*w*, 13*w* wires 11*c*, 13*c* conductors
11*i*, 12*i*, 13*i* insulating coating layers
11*e*, 12*e* end portions of wires 11*r* folded-back portion
12A, 12B, 12D, 12E, 12F, 12G, 12H, 12I, 12J sub-coils
12*a*, 12*b* sub-coil elements
12*s* elemental wire 12*c* stranded wire conductor
14 insulator
14*b* sleeve-like portion 14*f* frame-like portion
140 insulating paper 141 bobbin
1000 reactor
100, 100*z* magnetic cores 100$c_a$, 100$c_b$ inner core portions
100*e* outer core portion
110 coil
110*a*, 110*b* coil elements
110*w* wire
110*z*, 110*v*, 110*w*, 110*v* main coils 111*a*, 111*b* main coil elements
111$a_\alpha$, 111$a_\beta$, 111$b_\alpha$, 111$b_\beta$ split coils
120*z*, 120*v*, 120*x*, 120*w*, 120*v* sub-coils 120*a*, 120*b* sub-coil elements

The invention claimed is:

1. A reactor comprising:

a main coil formed by spirally winding a wire;

a sub-coil formed by spirally winding a wire that is different from the wire constituting the main coil; and a magnetic core to which both the main coil and the sub-coil are arranged, the magnetic core forming a closed magnetic path, wherein the sub-coil:

is arranged such that at least part of turns constituting the sub-coil is overlapped with the main coil, and has a portion in which a spacing between adjacent turns constituting the sub-coil is wider than a spacing between adjacent turns constituting the main coil, wherein the main coil and the magnetic core are configured to function as a reactor for smoothing, wherein the sub-coil and the magnetic core are configured to function as a reactor for resonance, wherein the main coil is an edgewise coil that is formed by winding a coated rectangular wire in an edgewise manner, the coated rectangular wire including a conductor made of a rectangular wire and an insulating coating layer formed on an outer periphery of the conductor, wherein the wire constituting the sub-coil is:

a coated round wire, which includes a conductor made of a round wire and an insulating coating layer formed on an outer periphery of the conductor, a coated electric wire, which includes a stranded wire conductor formed by stranding a plurality of elementary wires, and an insulating coating layer formed on an outer periphery of the stranded wire conductor, or a sheet-like wire that is formed by laminating an insulating material on a surface of a foil-like conductor, wherein a center position of the main coil in an axial direction thereof and a center position of the sub-coil in an axial direction thereof are shifted from each other in the axial direction, wherein a length of one of the main coil and the sub-coil in an axial direction thereof is shorter than a length of the other coil in an axial direction thereof, wherein a shift amount of the center position in the axial direction between the main coil and the sub-coil is 12 mm or less, and wherein the leakage inductance is 4.0 μH or less.

2. The reactor according to claim 1, wherein the sub-coil is concentrically arranged around the main coil.

3. The reactor according to claim 1, wherein the spacing between the adjacent turns is even for all of the adjacent turns constituting the sub-coil and is wider than the spacing between the adjacent turns of the main coil, the spacing between adjacent turns constituting the sub-coil is 0.3 mm or more, and the leakage inductance is 2.0 μH or less.

4. The reactor according to claim 1, wherein the sub-coil includes a pair of coil elements, each of the coil elements having a portion in which the spacing between the turns is wider, the magnetic core is an annular member including a pair of inner core portions over which the coil elements are arranged, respectively, and outer core portions arranged in sandwiching relation to the inner core portions that are arranged in parallel, and at least part of a wire forming turns of one of the coil elements and at least part of a wire forming the turns of the other coil element are arranged in overlapping relation in an axial direction of the sub-coil.

5. The reactor according to claim 1, wherein the sub-coil is concentrically arranged around the main coil, and an insulating member is interposed between the main coil and the sub-coil arranged around the main coil.

6. The reactor according to claim 1, wherein at least one of the main coil and the sub-coil includes a pair of coil elements, the magnetic core is an annular member including a pair of inner core portions over which the coil elements are arranged, respectively, and outer core portions arranged in sandwiching relation to the inner core portions that are arranged in parallel, and the main coil is formed by welding respective one end portions of the coated rectangular wires constituting the coil elements to each other.

7. The reactor according to claim 1, wherein at least one of the main coil and the sub-coil includes a pair of coil elements, the magnetic core is an annular member including a pair of inner core portions over which the coil elements are arranged, respectively, and outer core portions arranged in sandwiching relation to the inner core portions that are arranged in parallel, and the main coil is formed of one continuous coated rectangular wire, and the coil elements of the at least one coil are coupled to each other through a folded-back portion that is formed by folding back a part of the coated rectangular wire.

8. The reactor according to claim 1, wherein the conductor of the wire constituting the sub-coil is made of aluminum or an aluminum alloy.

9. The reactor according to claim 1, wherein the sub-coil is concentrically arranged around the main coil, and the sub-coil is a flatwise coil that is formed by winding a coated rectangular wire in a flatwise manner, the coated rectangular wire including a conductor made of a rectangular wire and an insulating coating layer formed on an outer periphery of the conductor.

10. The reactor according to claim 1, wherein the portion of the sub-coil, in which the spacing between the turns is wider, is formed by assembling the main coil and the sub-coil such that at least one of the turns constituting the main coil is present between the turns of the sub-coil.

11. The reactor according to claim 10, wherein the sub-coil has a portion in which plural turns constituting the sub-coil are sandwiched together between the turns constituting the main coil.

12. The reactor according to claim 10, wherein an assembly of the main coil and the sub-coil has a portion in which the wire forming each turn of the main coil and the wire forming each turn of the sub-coil are alternately arranged one by one.

13. The reactor according to claim 1, wherein the magnetic core includes:

an inner core portion arranged inside the main coil;

an outer core portion arranged outside an assembly of the main coil and the sub-coil; and a connecting core portion arranged at end surfaces of the main coil and the sub-coil.

14. The reactor according to claim 13, wherein the inner core portion includes an air gap.

15. The reactor according to claim 1, wherein the reactor is used as a component of a two-way soft-switching converter.

16. A method of adjusting a leakage inductance of a reactor, the method comprising the steps of:

arranging a main coil, which is formed by spirally winding a wire, around a magnetic core;

arranging a sub-coil, which is formed by spirally winding a wire different from the wire constituting the main coil a main coil, such that the sub-coil is overlapped with at least part of the main coil, and arranging the sub-coil to have a portion in which a spacing between adjacent turns constituting the sub-coil is wider than a spacing between adjacent turns constituting the main coil, thereby reducing a leakage inductance, wherein the main coil and the magnetic core function as a reactor for smoothing, wherein the sub-coil and the magnetic core function as a reactor for resonance, wherein the main coil is an edgewise coil that is formed by winding a coated rectangular wire in an edgewise manner, the coated rectangular wire including a conductor made of a rectangular wire and an insulating coating layer formed on an outer periphery of the conductor, wherein the wire constituting the sub-coil is:

a coated round wire, which includes a conductor made of a round wire and an insulating coating layer formed on an outer periphery of the conductor, a coated electric wire, which includes a stranded wire conductor formed by stranding a plurality of elementary wires, and an insulating coating layer formed on an outer periphery of the stranded wire conductor, or a sheet-like wire that is formed by laminating an insulating material on a surface of a foil-like conductor, wherein a center position of the main coil in an axial direction thereof and a center position of the sub-coil in an axial direction thereof are relatively shifted from each other, and the leakage inductance is adjusted by changing an amount of the shift, wherein a length of one of the main coil and the sub-coil in an axial direction thereof is shorter than a length of the other coil in an axial direction thereof, wherein a shift amount of the center position in the axial direction between the main coil and the sub-coil is 12 mm or less, and wherein the leakage inductance is 4.0 μH or less.

* * * * *